US009150399B2

(12) United States Patent
Michelli et al.

(10) Patent No.: US 9,150,399 B2
(45) Date of Patent: Oct. 6, 2015

(54) PORTABLE AND AUTOMATIC BOTTLE FILLING/CAPPING APPARATUS AND METHODS

(76) Inventors: Richard D. Michelli, Raleigh, NC (US); Laura Paramoure Michelli, Raleigh, NC (US)

( * ) Notice: Subject to any disclaimer, the term of this patent is extended or adjusted under 35 U.S.C. 154(b) by 1530 days.

(21) Appl. No.: 12/768,819

(22) Filed: Apr. 28, 2010

(65) Prior Publication Data

US 2010/0275556 A1 Nov. 4, 2010

Related U.S. Application Data

(60) Provisional application No. 61/174,635, filed on May 1, 2009.

(51) Int. Cl.
*B67B 3/00* (2006.01)
*B67C 7/00* (2006.01)
(Continued)

(52) U.S. Cl.
CPC . *B67C 7/00* (2013.01); *B67B 3/202* (2013.01); *B67C 3/007* (2013.01); *B67C 3/008* (2013.01)

(58) Field of Classification Search
CPC ..... B67C 3/20; B67C 3/204; B67B 3/02; B67B 3/06; B67B 3/062; B67B 7/00
USPC ..... 53/471, 478, 58, 504, 506, 67, 72, 276, 53/277, 282, 281, 55, 68, 69, 317, 331.5, 53/314; 141/129, 156, 157
See application file for complete search history.

(56) References Cited

U.S. PATENT DOCUMENTS 2,596,408 A * 5/1952 Johnson et al. ..... 53/72
3,424,209 A * 1/1969 Di Settembrini ..... 141/168
3,427,785 A 2/1969 Osterhage
(Continued)

FOREIGN PATENT DOCUMENTS

DE 1 917 667 A1 10/1970
DE 20 2004 001 619 U1 6/2004
GB 2 121 390 A 12/1983

OTHER PUBLICATIONS

International Preliminary Report on Patentability and Written Opinion of the International Searching Authority corresponding to International Application No. PCT/US2010/032652; Date of Mailing: Dec. 8, 2011; 18 pages.
(Continued)

*Primary Examiner* — Stephen F Gerrity
*Assistant Examiner* — Joy N Sanders
(74) *Attorney, Agent, or Firm* — Myers Bigel Sibley & Sajovec

(57) ABSTRACT

An automatic, portable water bottle filling apparatus includes an elongated frame that defines a continuous conveying path with opposite first and second ends; a conveyor system that moves bottles along the conveying path; a water filling station adjacent to the conveying path second end that is configured to fill an empty bottle with liquid from the user's water source; a capping station positioned downstream from the water filling station that is configured to close a filled bottle with a cap; a sensor system configured to detect the presence of an empty, uncapped bottle at the water filling station; and a controller that automatically controls operations of the water filling station, capping station and conveyor system in response to signals received from the sensor system.

23 Claims, 26 Drawing Sheets

(51) Int. Cl.
*B67B 3/20* (2006.01)
*B67C 3/00* (2006.01)

(56) References Cited

U.S. PATENT DOCUMENTS

| | | | | | |
|---|---|---|---|---|---|
| 3,438,174 | A | | 4/1969 | Foss et al. | |
| 3,797,536 | A | * | 3/1974 | Pinto et al. | 141/134 |
| 3,905,177 | A | | 9/1975 | Herzog | |
| 4,199,914 | A | | 4/1980 | Ochs et al. | |
| 4,559,759 | A | | 12/1985 | Herbert | |
| 4,922,684 | A | | 5/1990 | Nelson | |
| 5,012,630 | A | * | 5/1991 | Ingram et al. | 53/490 |
| 5,035,270 | A | | 7/1991 | Herzog | |
| 5,301,488 | A | * | 4/1994 | Ruhl et al. | 53/55 |
| 5,309,696 | A | * | 5/1994 | Heudecker et al. | 53/306 |
| 5,424,956 | A | | 6/1995 | Akamaru | |
| 5,473,855 | A | * | 12/1995 | Hidding et al. | 53/314 |
| 5,826,409 | A | * | 10/1998 | Slepicka et al. | 53/492 |
| 5,918,442 | A | | 7/1999 | Dewees et al. | |
| 6,023,910 | A | | 2/2000 | Lubus et al. | |
| 6,226,081 | B1 | | 5/2001 | Fantone et al. | |
| 6,446,680 | B1 | | 9/2002 | Soehnlen et al. | |
| 6,654,117 | B1 | * | 11/2003 | Reading | 356/240.1 |
| 7,325,372 | B2 | | 2/2008 | Bernhard | |
| 2005/0108994 | A1 | * | 5/2005 | Jacobs et al. | 53/510 |
| 2006/0113020 | A1 | | 6/2006 | Giacomazzi et al. | |
| 2007/0011994 | A1 | * | 1/2007 | Wooldridge | 53/473 |
| 2007/0095018 | A1 | * | 5/2007 | Perazzo et al. | 53/317 |
| 2008/0260907 | A1 | * | 10/2008 | Mazur | 426/66 |
| 2010/0037557 | A1 | * | 2/2010 | Wilhelm et al. | 53/331.5 |

OTHER PUBLICATIONS

International Search Report and Written Opinion of the International Searching Authority, or the Declaration corresponding to International Application No. PCT/US2010/032652; Date of Mailing: Nov. 24, 2011; 25 pages.

Invitation to Pay Additional Fees corresponding to International Application No. PCT/US2010/032652; Date of Mailing: Jun. 24, 2011; 10 pages.

* cited by examiner

PORTABLE AND AUTOMATIC BOTTLE FILLING/CAPPING APPARATUS AND METHODS

RELATED APPLICATION

This application claims the benefit of and priority to U.S. Provisional Patent Application No. 61/174,635 filed May 1, 2009, the disclosure of which is incorporated herein by reference as if set forth in its entirety.

FIELD OF THE INVENTION

The present invention relates generally to bottles and, more particularly, to methods and apparatus for filling bottles with a liquid.

BACKGROUND

According to the Beverage Marketing Corporation, bottled water emerged as the second largest commercial beverage category by volume in the United States in 2003, and has continued to grow at a significant pace. Bottled water consumption is growing even more rapidly on a global scale but in the U.S., volume is unparalleled. In 2007, total volume of bottled water in the U.S. surpassed 8.8 billion gallons, which translates to over 29 gallons per person. The growth has been even more impressive in terms of plastic water bottles sold: from 3.3 billion in 1997 to 15 billion in 2002, to over 35 billion in 2007.

The dramatic increase in the use of plastic water bottles has raised concerns regarding the amount of energy used to produce the plastic bottles and the environmental impact of disposing/recycling these bottles. It is estimated that less than twenty-five percent of all plastic water bottles in the U.S. are recycled. As such billions of plastic water bottles each year go into the trash or become litter. Some cities in the U.S. have considered banning plastic water bottles and/or imposing a tax of up to 25 cents per bottle.

An alternative to buying bottled water is to fill reusable bottles with water from the tap. Unfortunately, many find this inconvenient and time consuming compared with bottled water purchased from a store.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

In view of the above, an automatic, portable water bottle filling and capping apparatus, intended to provide users with filled and capped water bottles, filled from their own water source, is provided. According to some embodiments of the present invention, the apparatus includes an elongated frame that defines a conveying path; a conveyor system that moves bottles along the conveying path; a water filling station adjacent to the conveying path that is configured to fill an empty bottle with liquid from the user's water source; a capping station positioned downstream from the water filling station that is configured to close a filled bottle with a cap; a sensor system configured to detect the presence of an empty, uncapped bottle at the water filling station; and a controller that controls operations of the water filling station, capping station and conveyor system in response to signals received from the sensor system. In some embodiments, the frame is enclosed within a housing to reduce the likelihood of contamination caused by the ingress of foreign material and to protect users from the various moving parts. In some embodiments, the frame includes a floor and at least one panel vertically spaced from the floor and substantially parallel therewith. The at least one panel has an opening formed therein that defines the conveying path. Bottles supported on the floor in an upright position are movable along the conveying path. The housing includes an access door that is movable between closed and opened positions to provide access to the conveying path, thereby allowing users to place empty bottles on the conveying path and to remove filled bottles therefrom.

In some embodiments, the conveyor system includes a friction drive pulley supported by the frame adjacent to a first end of the conveying path, a belt drive pulley supported by the frame adjacent to a second end of the conveying path, and an endless belt extending about the friction drive and belt drive pulleys that is configured to frictionally engage bottles in the conveying path. A motor assembly is supported by the frame and includes a motor and motor shaft that is rotatably driven by the motor. The belt drive pulley is operatively coupled to the motor shaft and rotation of the belt drive pulley via the motor causes the endless belt to move and thereby convey bottles along the conveying path. In some embodiments, a pair of endless belts with corresponding drive belt pulleys and friction belt pulleys may be utilized.

The endless belt may be configured to frictionally engage bottles adjacent the conveying path second end with a greater force than bottles adjacent the conveying path first end. This is because bottles adjacent the second end of the conveying path are typically filled bottles and, thus, require more force to move along the conveying path than empty bottles.

The water filling station includes a nozzle positioned above the conveying path and a conduit coupled at an inlet with the water source and at an outlet with the nozzle. The conduit also includes a valve that is configured to control the flow of water through the nozzle from the water source. The conduit may also include a water filter/purifier device. A water source may be any source that can provide pressurized water including, but not limited to, water from a municipal service, water from a ground well, water from a bulk supply, such as a five gallon container, etc.

The conveyor system also includes a gate movably supported by the frame upstream of the water filling station. The gate is movable between open and closed positions. The gate blocks bottle movement along the conveying path when in the closed position and allows bottle movement along the conveying path when in the open position. The gate is configured to prevent bottle movement even with movement of the endless belt. The gate is configured to ensure only one bottle at a time feeds into the capping station.

The capping station includes a screw cap dispenser supported by the frame and positioned above the conveying path. The dispenser includes an outlet that is configured to releasably retain a screw cap therein such that the mouth of a bottle moving along the conveying path from the water filling station makes contact with the inside wall of the screw cap and causes the outlet to release the screw cap onto the bottle mouth. The capping station also includes an arcuate wall positioned above the conveying path downstream from the dispenser outlet, a free-spinning wheel positioned above the conveying path downstream from the dispenser outlet in spaced-apart, substantially concentric relationship with the arcuate wall, and a rotatable gripper arm operatively coupled to the motor shaft. The gripper arm is configured to engage a bottle located under the dispenser outlet and move the bottle along the conveying path a predetermined arcuate distance. Movement of the bottle along the predetermined arcuate distance causes a cap positioned on the bottle mouth to frictionally engage the arcuate wall and wheel and rotate relative to the bottle and so as to become threadingly engaged with the bottle mouth. In some embodiments, the arcuate wall includes a tactile surface that resists slippage of a cap in contact therewith.

The capping station also includes a guide panel positioned above the conveying path second end. The guide panel includes an inclined surface that is configured to engage an upper surface of a screw cap and apply downward pressure on the cap as the bottle is moved along the predetermined distance by the gripper arm and engaged by the arcuate wall and wheel. In some embodiments, the guide panel has an arcuate configuration.

The screw cap dispenser includes an elongated bottom wall and a pair of spaced-apart, elongated side walls that extend upwardly from the bottom wall to define a channel sized to slidably receive a plurality of screw caps therein in single file arrangement. The channel is inclined relative to horizontal such that screw caps within the channel are gravity-fed to the dispenser outlet. In some embodiments, at least one side wall has a free edge with an inwardly extending lip. The inwardly extending lip is configured to permit a screw cap in an upright orientation to slide along the channel, but to not permit a screw cap in an inverted orientation to slide along the channel. This configuration prevents screw caps from being incorrectly loaded in the dispenser.

In some embodiments, the sensor system includes a first sensor configured to detect the presence of a bottle at the forward position of the travel path, just before the entrance to the liquid filling station. This sensor is configured to detect and uniquely identify either an uncapped bottle, a capped bottle, or no bottle. A second sensor is configured to the detect the presence of a bottle near the end of the liquid filling station, such that a single bottle in view of both the first and second sensors is undoubtedly positioned under the filling nozzle, so that any liquid released from the dispenser will end up in the bottle. A third sensor is configured to detect a liquid level in the bottle at the liquid filling station. The sensor system also includes a fourth sensor configured to detect the presence of a cap at the cap dispenser outlet.

Filling and capping apparatus, according to embodiments of the present invention, are easy to install and use by consumers. Moreover, because the apparatus has a small footprint (e.g., a footprint no larger than about 240 $in^2$) and is lightweight, portability is enhanced. In some embodiments of the present invention, filling and capping apparatus may be configured to be installed within refrigerators and other water cooling devices.

According to other embodiments of the present invention, a portable bottle filling apparatus includes an elongated frame that defines a conveying path; a conveyor system that moves bottles along the conveying path; a liquid filling station adjacent to the conveying path that is configured to fill an empty bottle with liquid from a liquid source; and a capping station positioned downstream from the liquid filling station that is configured to close a filled bottle with a screw cap. The capping station includes a screw cap dispenser positioned above the conveying path. The dispenser includes an outlet that is configured to releasably retain a screw cap therein such that the mouth of a bottle moving along the conveying path from the water filling station makes contact with the inside wall of the screw cap and causes the outlet to release the screw cap onto the bottle mouth. The capping station also includes an arcuate wall positioned above the conveying path downstream from the dispenser outlet, a free-spinning wheel positioned above the conveying path downstream from the dispenser outlet in spaced-apart relationship with the arcuate wall, and a gripper arm. The gripper arm is configured to engage a bottle located under the dispenser outlet and move the bottle along the conveying path a predetermined arcuate distance. Movement of the bottle along the predetermined arcuate distance causes a cap positioned on the bottle mouth to frictionally engage the arcuate wall and wheel and rotate relative to the bottle and so as to become threadingly engaged with the bottle mouth. The capping station also includes a guide panel positioned above the conveying path second end. The guide panel includes an inclined surface that is configured to engage an upper surface of a screw cap and apply downward pressure on the cap as the bottle is moved along the predetermined arcuate distance by the gripper arm and engaged by the arcuate wall and wheel.

According to some embodiments of the present invention, a method of filling a bottle with liquid (e.g., water) includes filling an empty bottle with liquid from a liquid source (e.g., a residential water source), and capping the filled bottle by moving the filled bottle along an arcuate path so as to cause a screw cap positioned on the mouth of the bottle to rotate relative to the bottle and threadingly engage the mouth of the bottle. As the bottle is moved along the arcuate path, the screw cap positioned on the bottle mouth is frictionally engaged by a fixed arcuate wall and a free-spinning wheel spaced-apart from the arcuate wall. In some embodiments, as the bottle is moved along the arcuate path, a downward pressure is applied to the screw cap by a guide panel positioned above the arcuate path. In some embodiments, the guide panel has an inclined surface that engages an upper surface of the screw cap and applies downward pressure on the cap as the bottle is moved along the arcuate path.

Other apparatus and methods according to exemplary embodiments will be or become apparent to one with skill in the art upon review of the following drawings and detailed description. It is intended that all such additional apparatus and methods be included within this description, be within the scope of the present invention, and be protected by the accompanying claims.

BRIEF DESCRIPTION OF THE DRAWINGS

The accompanying drawings, which form a part of the specification, illustrate some exemplary embodiments. The drawings and description together serve to fully explain the exemplary embodiments.

DETAILED DESCRIPTION

Figure 2:
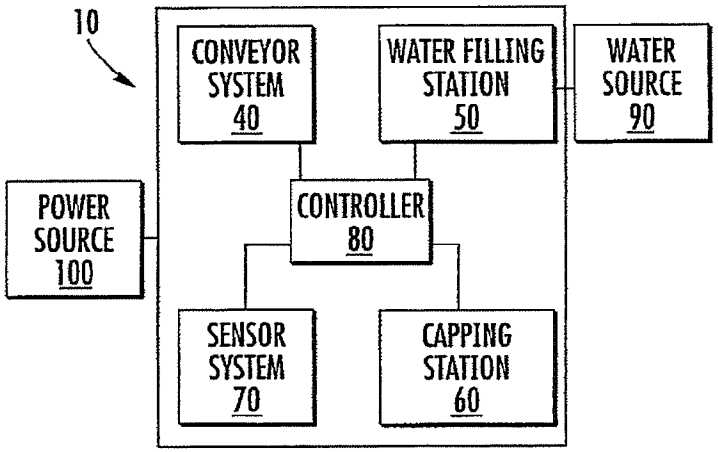
FIG. 2 is a block diagram of the water bottle filling apparatus of FIG. 1 illustrating various components thereof.

The present invention now is described more fully hereinafter with reference to the accompanying drawings, in which some embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

It will be understood that although the terms first and second are used herein to describe various features/elements, these features/elements should not be limited by these terms. These terms are only used to distinguish one feature/element from another feature/element. Thus, a first feature/element discussed below could be termed a second feature/element, and similarly, a second feature/element discussed below could be termed a first feature/element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although described herein as a water bottle filling apparatus, embodiments of the present invention may be used to fill and cap bottles and other containers with various types of beverages and liquids, without limitation. Embodiments of the present invention are not limited to filling and capping water bottles.

Figure 1:
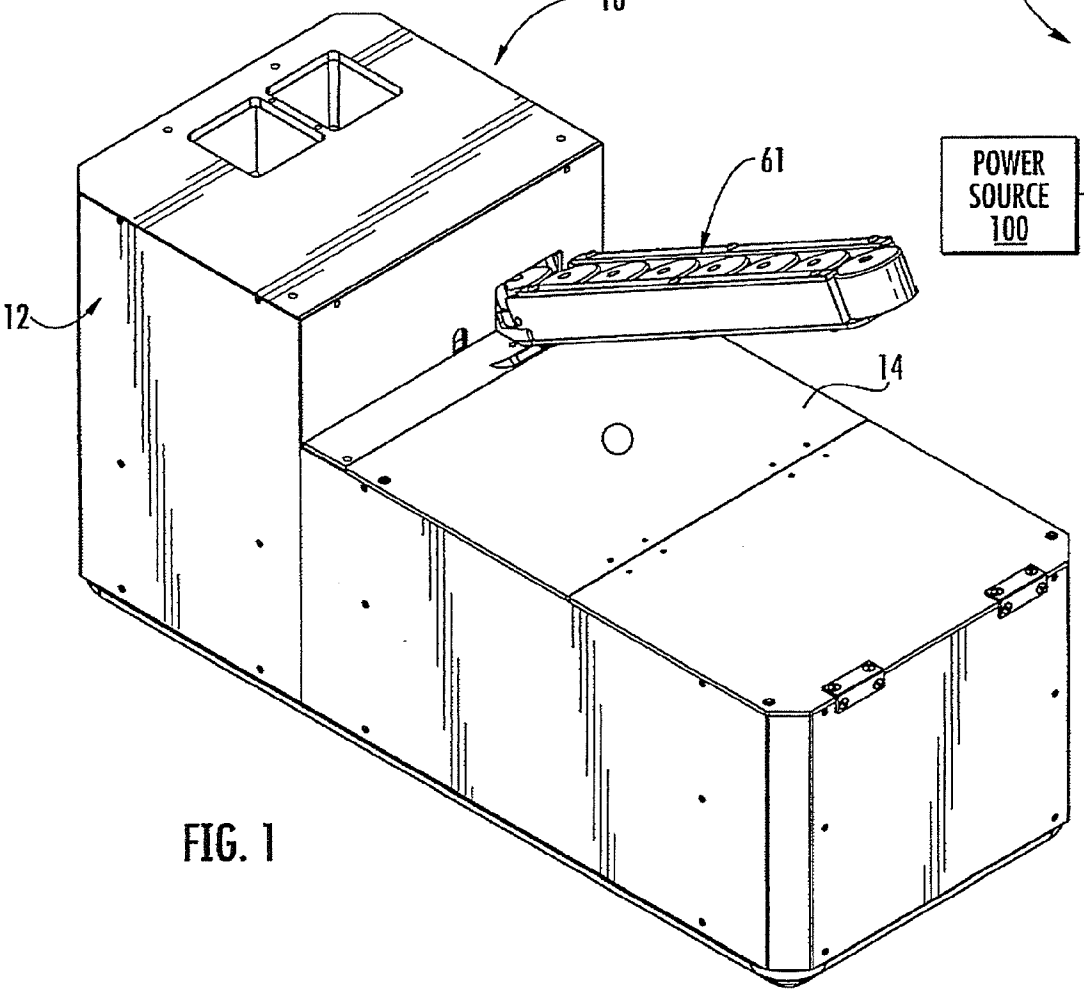
FIG. 1 is a top perspective view of a portable, automatic water bottle filling apparatus, according to some embodiments of the present invention.

Referring initially to FIGS. 1-4, a portable, automatic water bottle filling and capping apparatus 10, according to some embodiments of the present invention, is illustrated. FIG. 1 is a top perspective view of the apparatus 10 and FIG. 2 is a block diagram of the various components of the apparatus 10. The illustrated apparatus 10 includes the following components that will be described below in detail: a conveyor system 40 that moves bottles along a conveying path; a water filling station 50; a capping station 60; a sensor system 70 that is configured to detect the presence of empty, uncapped bottles at the water filling station 50; and a controller 80 that controls operations of the water filling station 50, capping station 60 and conveyor system 40 in response to signals received from the sensor system 70. The water filling station 50 is configured to fill empty bottles with water from a water source 90, such as a pressurized residential water source. The capping station 60 is configured to close a filled bottle with a screw-type cap. The sensor system 70 is configured to detect the presence of empty, uncapped bottles at the water filling station 50. The sensor system 70 is also configured to detect whether the cap dispenser contains screw caps. Each of these components will be described in detail below.

The various components of the apparatus 10 are configured to receive electrical power from a power source 100. Power source 100 may be an external AC or DC power source or may be an internal power source (e.g., battery power source).

The various components of the apparatus 10 are supported on a frame 20 (FIG. 3) that is surrounded by a housing 12. The housing 12 provides a sealed environment for the various components of the apparatus and for the bottles contained therewithin. The housing 12 reduces the likelihood of contamination caused by the ingress of foreign material into uncapped bottles and into the various components of the apparatus 10. In addition, the housing 12 separates the user from the moving components of the apparatus 10.

The illustrated housing 12 includes an access door 14 (FIG. 1) that is movable between closed and opened positions to allow users to insert and remove bottles from the apparatus 10. The position of the access door 14 (open or closed) is monitored by a sensor in communication with the system controller 80 and permits automatic operation. For example, upon closing of the access door 14, the controller 80 checks the status of the various sensors configured to detect the presence of an empty, uncapped bottle 31 at the water filling station 50. If an empty uncapped bottle 31 is present, then the filling cycle begins. If no bottle 31 is present, the conveyor system 40 is energized which feeds any present bottles forward. This continues until an empty bottle is sensed, or a timeout expires.

Conveyor System

Figure 3:
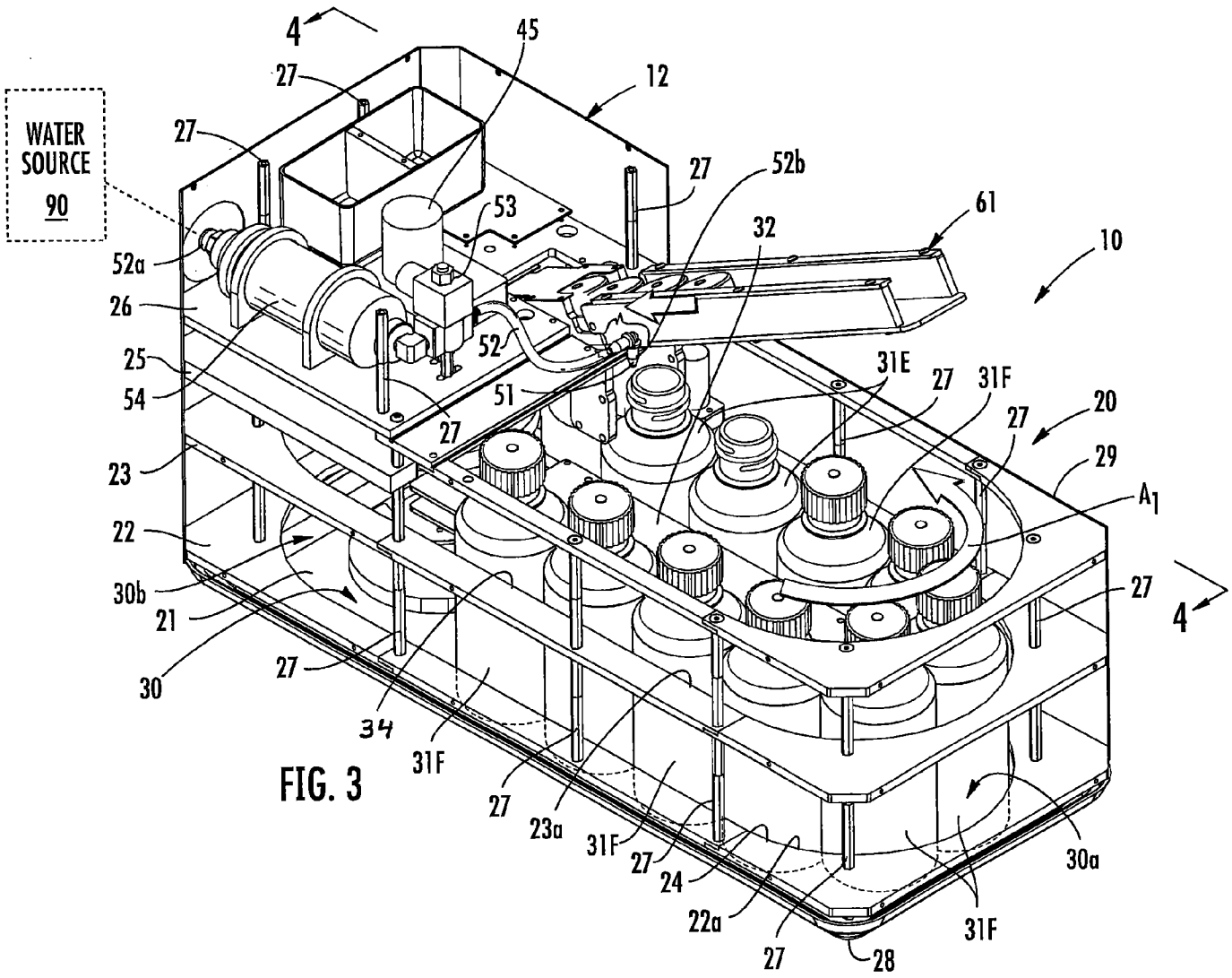
FIG. 3 illustrates the portable water bottle filling apparatus of FIG. 1 with the housing partially removed.
Figure 4:
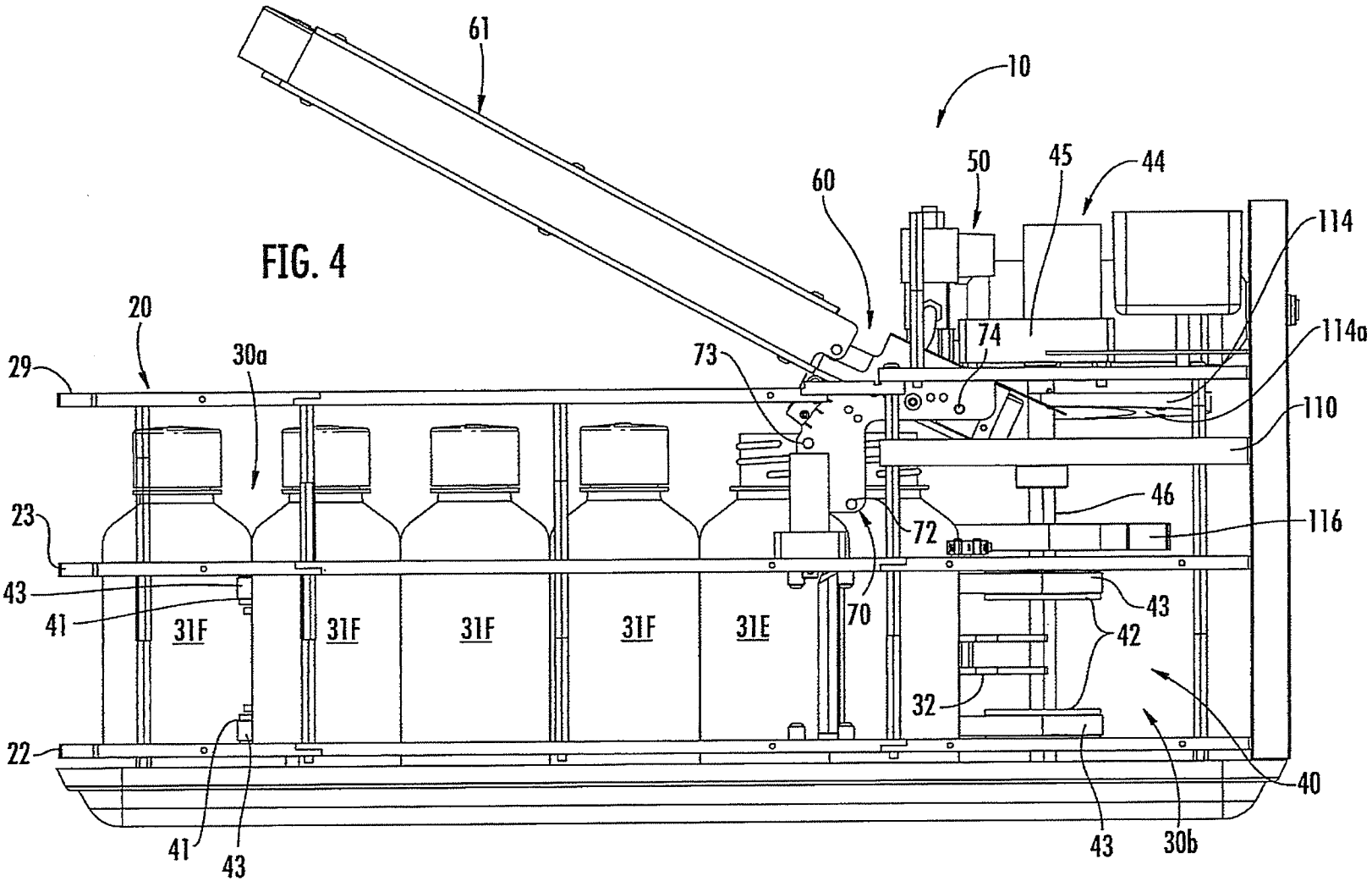
FIG. 4 is a side elevation view of the water bottle filling apparatus of FIG. 3, taken along lines 4-4, and with the housing removed for clarity.

Referring to FIGS. 3-4, the illustrated frame 20 has an elongated configuration and includes a floor 21 and a plurality of panels 22, 23, 25, 26, 29 that are vertically spaced from the floor 21 and substantially parallel therewith. The panels are interconnected with each other and with the floor 21 via a plurality of substantially vertical support members 27. A drip pan 28 is positioned beneath the floor and is configured to catch and retain water spilled during operations of the apparatus 10.

Two of the illustrated panels, 22, 23 have openings 24, 34 formed therein that define a continuous conveying path 30 with opposite first and second ends 30*a*, 30*b*. The continuous conveying path 30 is configured such that bottles 31 supported on the floor 21 in an upright position are movable along the conveying path 30. Upper panel 29 includes an opening formed therein, as illustrated, that provides user access (when access door 14 in housing 12 is opened) to the conveying path 30 for placing empty bottles 31E on the conveying path 30 and for retrieving filled bottles 31F from the conveying path 30.

The frame 20 also supports the various components of the apparatus 10. For example, in the illustrated embodiment, panel 26 supports various components of the water filling station 50 (nozzle 51, conduit 52, valve 53, filter/purifier 54, etc.). Panel 26 also supports the motor 45 that drives the conveyor system 40 and the capping station 60. Panel 26 also supports the cap dispenser 61 for the capping station 60. Other portions of the frame 20 support the remaining components of the apparatus 10.

The housing 12 and the frame 20 may be formed from various materials including, but not limited to, polymeric materials, metal materials, etc. Various materials such as wood, granite, etc. may also be incorporated for aesthetic reasons. In some embodiments, the housing may be a clear material, such as an acrylic, to permit viewing of the various components therein and to permit viewing of bottle filling operations. In other embodiments, the access door 14 may be a clear material, such as an acrylic, to permit viewing of the various components therein and to permit viewing of bottle filling operations. To facilitate portability, the housing 12 and frame 20 may be formed from lightweight materials, such as aluminum, plastic or wood.

In some embodiments of the present invention, to facilitate portability, the apparatus 10 has a footprint of no more than about 240 $in^2$. As known to those of skill in the art, the term "footprint" refers to the amount of space a device occupies. However, embodiments of the present invention are not limited to any particular footprint size.

Embodiments of the present invention are not limited to the illustrated housing 12 and frame 20 configurations. The frame 20 and housing 12 may have various shapes and configurations, without limitation.

The conveying path 30 holds both full and empty bottles, which are conveyed into and out of the filling and capping stations 50, 60. The illustrated continuous conveying path 30 has a closed (i.e., endless), oval shape. However, other conveyor path shapes are possible in accordance with embodiments of the present invention. For example, a continuous conveying path having a serpentine configuration may be utilized, as well as a finite path with definite start and end points.

In operation, a user places empty bottles 31E on the conveying path 30. When all of the empty bottles 31E have been filled by the apparatus 10, the filled bottles 31F occupy the same location on the conveying path 30 where the empty bottles 31E were placed. Utilizing the same conveying path area as storage for both full and empty bottles is an efficient use of space and helps to reduce the overall footprint of the apparatus 10.

The illustrated conveying path 30 is defined by the floor 21, the openings 24, 34 in spaced-apart panels 22, 23, and a pair of endless belts 43 and central supporting structure 32, as illustrated in FIGS. 3 and 4. The edge portions 22*a*, 23*a* of spaced-apart panels 22, 23 that define openings 24, 34 serve as a stationary outer wall or boundary of the conveying path. Bottles supported on the floor 21 in an upright position are movable along the conveying path 30 via the endless belts 43 which frictionally engage the bottles. Movement of the endless belts 43 cause the bottles to roll about a vertical axis along the edge portions 22*a*, 23*a* of spaced-apart panels 22, 23 and consequently move in the feed direction, indicated by arrow $A_1$ in FIG. 3.

The panels 22, 23 and endless belts 43 are vertically spaced with respect to each other, as illustrated. Panel 23 is located near the top of the bottles positioned within the conveying path, panel 22 is located near the bottom of the bottles 31, and the endless belts 43 are located between the two panels 22, 23. This arrangement provides stable four-point contact with each bottle. The spacing between the panel openings 24, 34 and the endless belts 43 is such that bottles contained within the conveying path 30 are squeezed slightly by the endless belts 43, providing the necessary friction force for the endless belts 43 to impart motion to the bottles.

However, embodiments of the present invention are not limited to the illustrated structure of conveying path 30. Conveying path 30 may be defined by a single panel vertically spaced-apart from the floor 21, or by more than two vertically spaced-apart panels, for example. In other embodiments, the apparatus 10 may utilize a solid frame structure, having the conveying path 30 molded or machined therein. Additionally, the drive system may be configured to directly move the bottles via mechanical features such as fingers or guides rather than by friction.

The illustrated conveyor system 40 includes a pair of friction drive pulleys 41 supported by the frame 20 adjacent to the conveying path first end 30*a*, a pair of belt drive pulleys 42 supported by the frame adjacent to the conveying path second end 30*b*, and a corresponding pair of endless belts 43 extending about the friction drive and belt drive pulleys 41, 42. A motor assembly 44 is supported by the frame 20, and includes a motor 45 and motor shaft 46 that is rotatably driven by the motor 45. The pair of belt drive pulleys 42 are operatively coupled to the motor shaft 46. Rotation of the belt drive pulleys 42 via the motor 45 causes the endless belts 43 to move and convey bottles along the conveying path 30.

In some embodiments of the present invention, the endless belts 43 frictionally engage bottles at the water filling station 50 adjacent the conveying path second end 30*b* with a greater force than bottles adjacent the conveying path first end 30*a*. This is because as the bottles at the water filling station 50 change from an empty state to a full state, a greater force to move them is required. Causing the endless belts 43 to frictionally engage bottles with greater force at the conveying path second end 30*b* may be accomplished in various ways. For example, in some embodiments, belt drive pulleys 42 may have a larger diameter than the friction drive pulleys 41. In other embodiments, the central supporting structure 32 may include one or more members that have a diverging configuration and that engage the endless belts 43 adjacent the drive belt pulleys 42, thereby forcing the endless belts 43 outward. In other embodiments, the openings 24, 34 in panels 22, 23 may be narrowed somewhat at the conveying path second end 30*b*.

In operation, bottles move continuously along the conveying path 30 with two stops. The first stop is a holding point, where a stop mechanism or gate 47 holds the bottles and prevents their forward motion even though the endless belts 43 may be moving. The second stop is at the filling station 50, where an empty bottle 31E is positioned under the nozzle 51 where water is dispensed to fill the empty bottle 31E.

Figure 5:
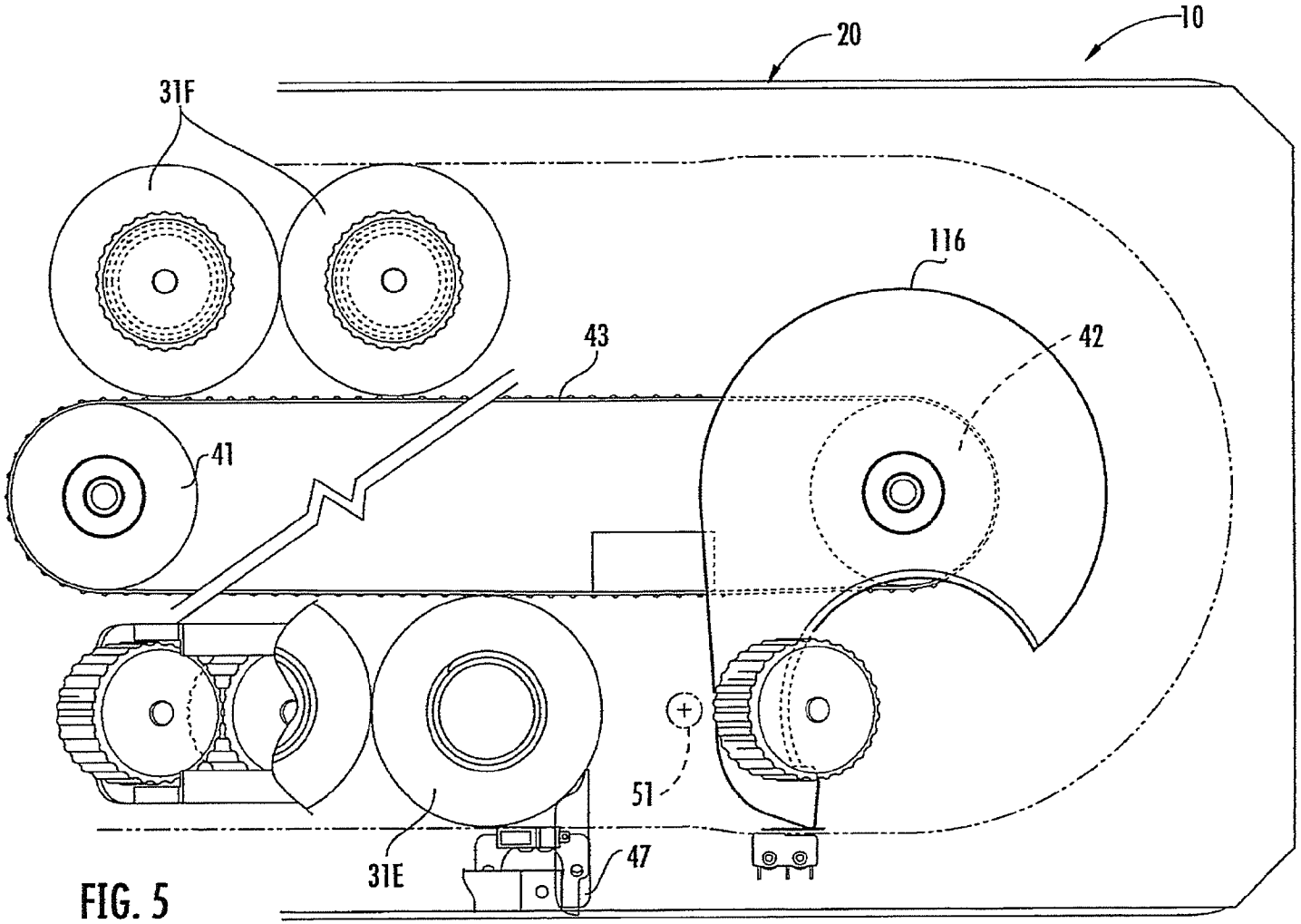
FIGS. 5-17 are partial plan views of the water bottle filling apparatus of FIG. 3, illustrating sequential operations for filling a bottle with water and capping the bottle, according to some embodiments of the present invention.

A gate 47 (FIG. 5) is movably supported by the frame 20 upstream from the water filling station 50, and is movable between open (FIG. 8) and closed positions (FIG. 5). The gate 47 blocks bottle movement along the conveying path 30 when in the closed position and allows bottle movement along the conveying path 30 when in the open position. The gate 47, when closed, ensures that an additional bottle will not feed into the filling/capping region while a preceding bottle is being capped.

Cap Storage/Feeding

Figure 23:
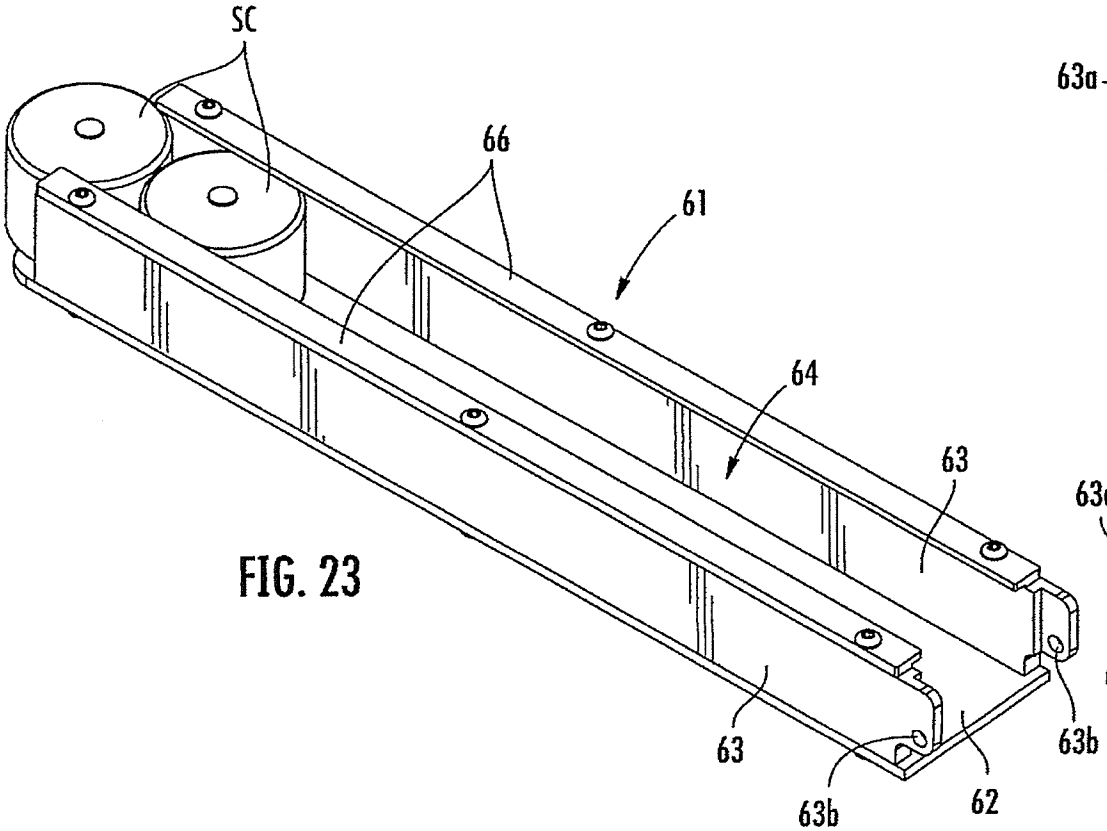
FIG. 23 is a top perspective view of the cap dispenser for the water bottle filling apparatus of FIG. 3.

The capping station 60 includes a screw cap dispenser 61 that is supported by the frame 20 and positioned above the conveying path 30, as illustrated in FIGS. 3 and 4. As illustrated in FIG. 23, the dispenser 61 includes an elongated bottom wall 62, and a pair of spaced-apart, elongated side walls 63 that extend upwardly from the bottom wall 62 to define a channel 64. The channel 64 is sized to slidably receive a plurality of screw caps SC therein in single file arrangement. The dispenser 61 includes an outlet 65 (FIG. 26) that is configured to releasably retain a screw cap SC therein such that the mouth 31*a* of a bottle 31 moving along the conveying path 30 from the liquid filling station 50 makes contact with the screw cap SC and causes the outlet 65 to release the screw cap SC onto the bottle mouth 31*a*. The channel 64 is inclined relative to horizontal such that screw caps SC within the channel 64 are gravity-fed to the dispenser outlet 65. The outlet 65 is movably secured to the dispenser 61 to allow the dispenser 61 to pivot between inclined and non-inclined positions. In the illustrated embodiment, outlet 65 includes a pair of spaced apart arms 69, each having a pin 69*a* extending outwardly therefrom. Each pin 69*a* is configured to be inserted within a corresponding aperture 63*a* of a side wall 63 of the dispenser 61.

Figure 24:
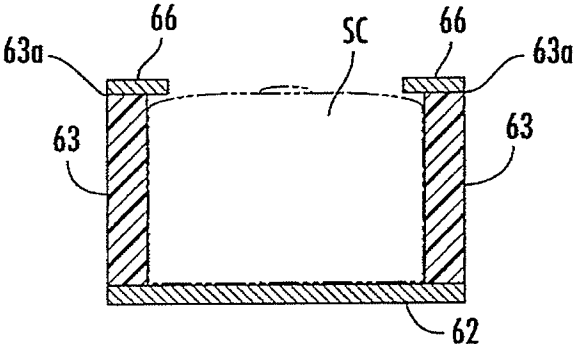
FIG. 24 is a cross sectional view of the cap dispenser of FIG. 23 illustrating a cap inserted therein correctly.
Figure 25:
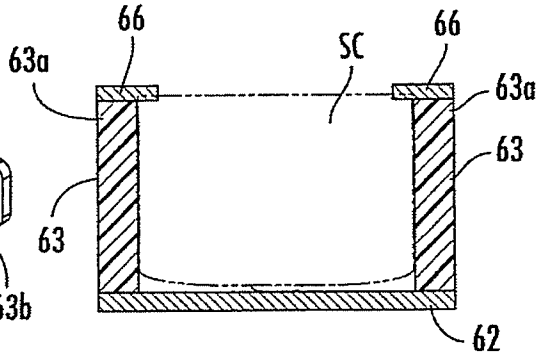
FIG. 25 is a cross sectional view of the cap dispenser of FIG. 23 illustrating a cap inserted therein upside down.

As illustrated in FIGS. 23-25, each side wall 63 includes a free edge 63*a* having an inwardly extending lip 66. The inwardly extending lips 66 are configured to permit a screw cap SC in an upright (i.e., correct) orientation (FIG. 24) to slide along the channel 64, and to not permit a screw cap SC in an inverted (i.e., incorrect) orientation (FIG. 25) to slide along the channel 64. As such, screw caps SC cannot be placed into the dispenser 61 incorrectly (i.e., upside down). Although in the illustrated embodiment both side wall free edges 63*a* include inwardly facing lips 66, in other embodiments, a lip 66 extending inwardly from only one side wall free edge 63*a* may be sufficient to prevent screw caps SC from being fed upside down.

Figure 19:
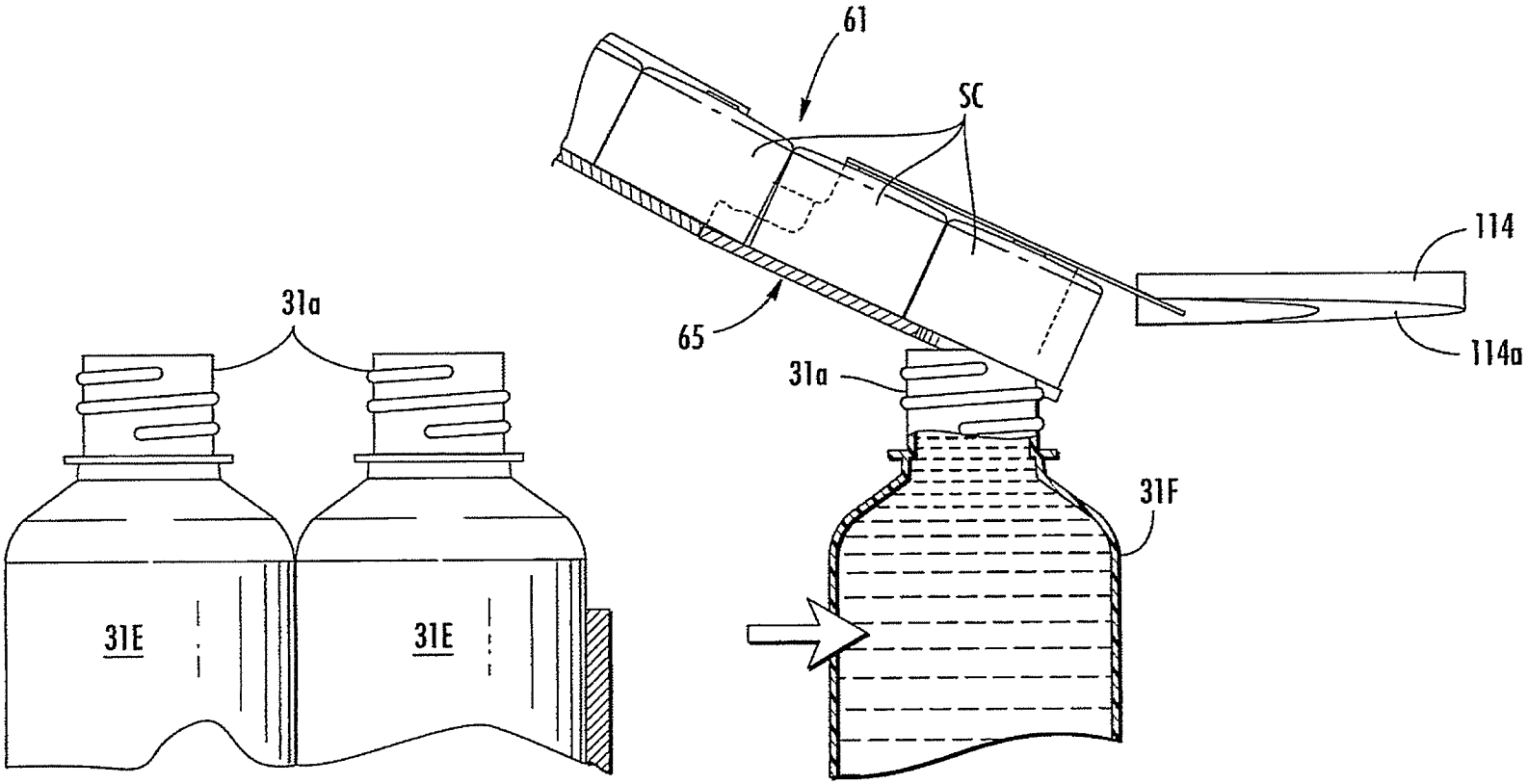
Figure 20:
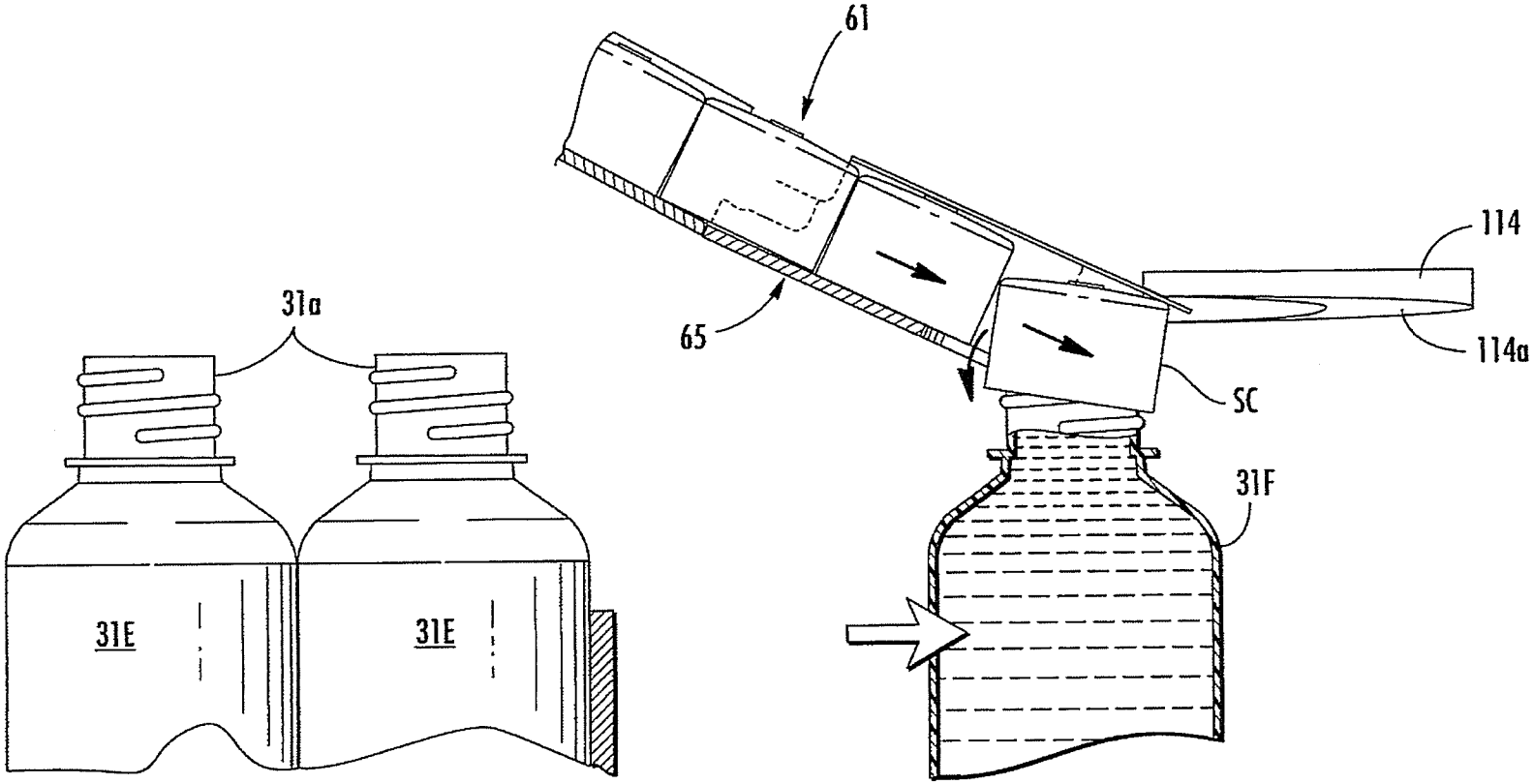
Figure 27:
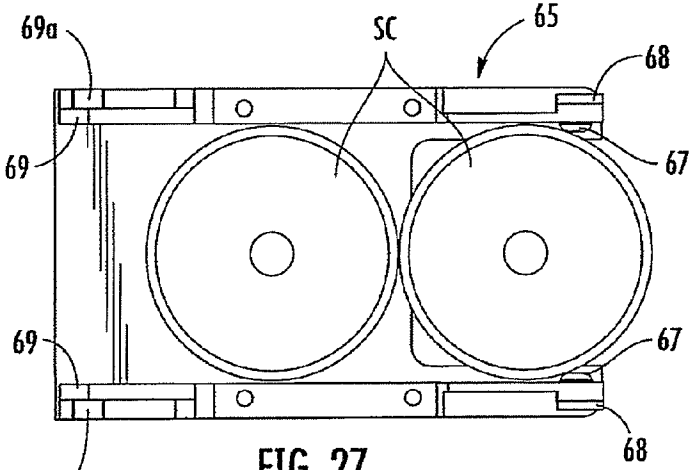
FIGS. 27 and 28 are partial plan views of the cap dispenser outlet of FIG. 26 illustrating a cap retained therein (FIG. 27) and a cap being removed therefrom (FIG. 28).
Figure 28:
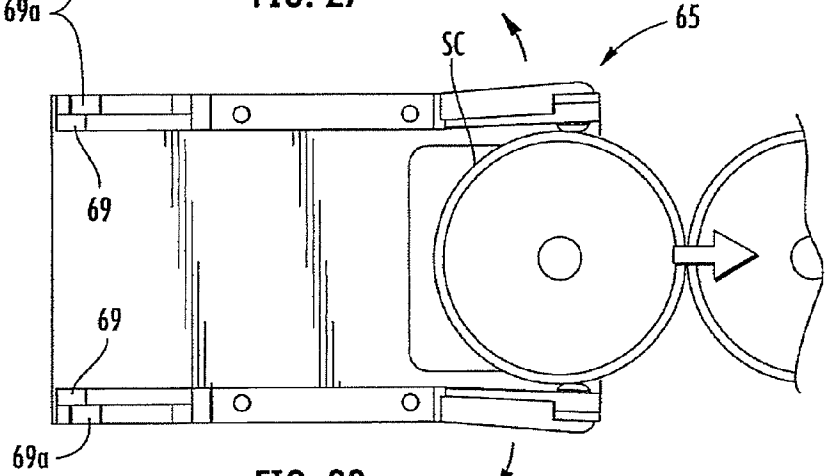
Figure 26:
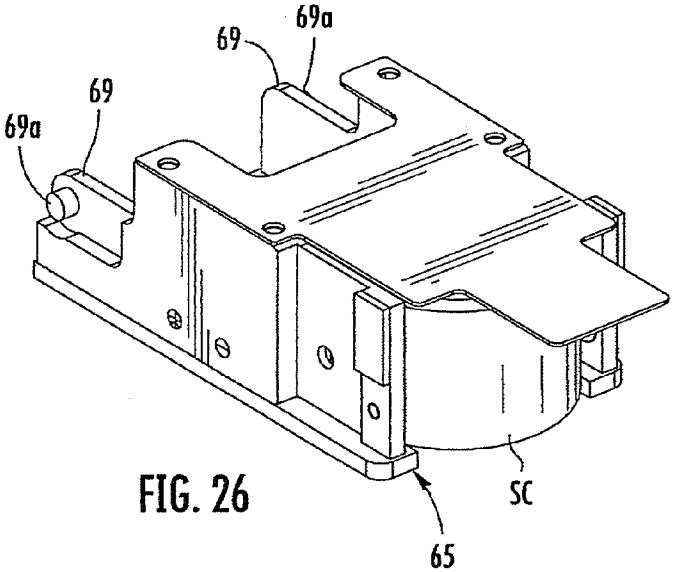
FIG. 26 is a partial perspective view of the outlet of the cap dispenser for the water bottle filling apparatus of FIG. 3, according to some embodiments of the present invention.

Referring to FIGS. 26-28, the screw cap dispenser outlet 65 is illustrated in further detail. The outlet 65 is configured to prevent the screw caps SC from falling out, and to release a single cap SC when sufficient force is applied by the mouth 31*a* of a bottle (FIG. 19). In the illustrated embodiment, the outlet 65 includes protrusions 67, mounted on arms 68, that act as a stop. When a bottle moves beneath the cap dispenser outlet 65, the mouth 31*a* of the bottle contacts the inner wall of the a screw cap SC and pulls the screw cap SC along. The stop arms 68 flex out of the way, and the screw cap SC is released. Immediately after the screw cap SC is released, the arms 68 snap back into place preventing the next screw cap SC from falling out.

Figure 29:
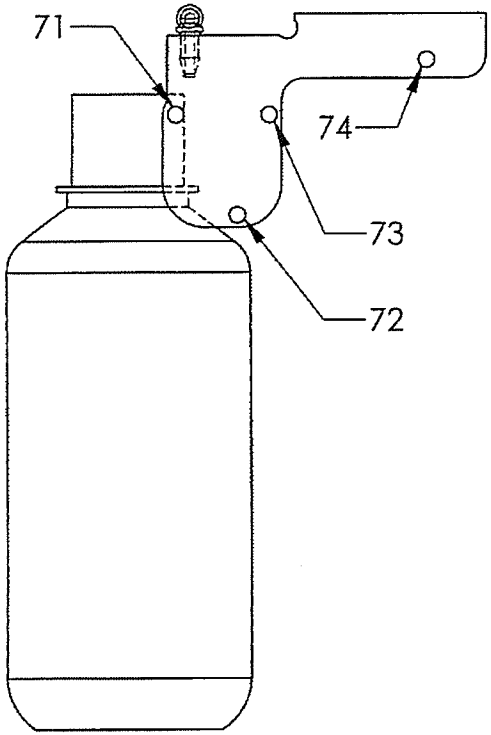

Referring to FIG. 29, a sensor 74 is positioned adjacent to the cap dispenser outlet 65 and is configured to detect if a screw cap SC is present at the outlet 65. In some embodiments, the sensor 74 may be a thru-beam infrared emitter-detector pair. However, other types of sensors may be utilized, as would be understood by those skilled in the art. The status of sensor 74 is used by the control algorithm of the system controller 80 to decide if the bottles will be processed, or to signal the user, via a display or status indicator, that the dispenser 61 is out of screw caps SC.

Bottle Filling/Sensing

Referring to FIGS. 3 and 5, the water filling station 50 includes a nozzle 51 positioned above the conveying path 30. A water line or conduit 52 is coupled at an inlet 52*a* with a water source 90 and at an outlet 52*b* with the nozzle 51. The conduit 52 includes a valve 53 that is configured to control the flow of water through the nozzle 51 from the water source 90. The valve 53 is in communication with the controller 80 and is activated by the controller 80 to open in response to detecting an empty bottle 31E positioned beneath the nozzle 51, as will be described further below. In the illustrated embodiment, the conduit 52 also includes a water filter/purifier device 54.

The sensor system 70 is positioned adjacent to the liquid filling station 50, as illustrated in FIG. 4, and is configured to detect the presence of an empty, uncapped bottle at the liquid filling station 50. The illustrated sensor system 70 includes a first sensor 71 (FIG. 29) configured to detect the presence of a bottle at the liquid filling station 50, a second sensor 72 configured to detect a liquid level in a bottle at the liquid filling station 50, and a third sensor 73 configured to detect the presence of a cap on a bottle at the liquid filling station 50. The illustrated sensor system 70 also includes a fourth sensor 74 that detects the presence/absence of caps at the cap dispenser outlet 65, as described above. In some embodiments, the first, second, and third sensors 71, 72, 73 are thru-beam infrared emitter-detector pairs. However, other types of sensors may be utilized, as would be understood by those skilled in the art.

Figure 31:
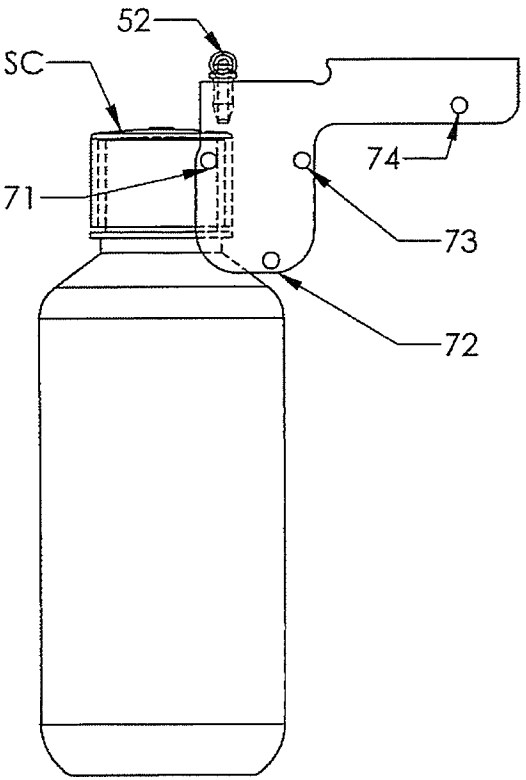
FIGS. 29-31 are partial side elevation vies of the sensor system sensors and the positioning of a bottle relative thereto.
Figure 30:
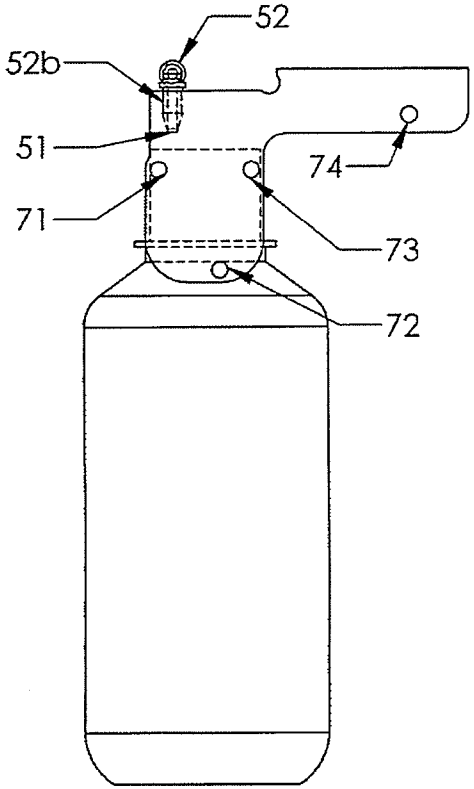

Referring to FIGS. 29, 30, and 31, the first, second, and third sensors 71, 72, 73 will be described in further detail. The first sensor 71 is configured to detect the position of a bottle. The first sensor 71 monitors when a bottle begins to enter the filling station 50. The first sensor 71 has three distinct states: uncapped bottle present, capped bottle present, and no bottle present. The three states are determined by the amount of infrared light blocked between the emitter and detector components. No light blocked means no bottle present, some light blocked means an uncapped bottle present, and all (or most)

light blocked means a full bottle present. If an uncapped bottle is detected, it will be processed (assuming screw caps are available). If a capped bottle is detected, the system will rest.

The second sensor 72 is configured to detect full/empty status of a bottle. The second sensor 72 is positioned between sensors 71 and 73, and not directly below nozzle 51. This ensures that if both the first and third sensors 71, 73 detect a bottle at the same time, then filling sensor 72 will be appropriately positioned to detect the fill level, and that liquid dispensed from filling nozzle 51 will not interfere with the sensor's reading. Once an empty bottle 31E is sensed by the first and third sensors 71, 73, filling is begun and continues until sensor 72 changes state from empty to full.

The third sensor 73 is configured to work in conjunction with first sensor 71 to ensure proper bottle placement under the filling nozzle 51. The third sensor 73 is positioned such that the center of the filling nozzle 51 is located between the third sensor 73 and the first sensor 71. This ensures that if both the first and third sensors 71, 73 detect a bottle at the same time, then the filling nozzle 51 will safely align with the opening of the mouth of the bottle so water does not spill.

Embodiments of the present invention are not limited to the use of sensors for automatic filling operations, as described above. Various techniques for controlling automatic filling may be utilized by the apparatus 10, as well as apparatus 200 and 300 described below with respect to FIGS. 32 and 33. For example, in some embodiments, a float valve may be utilized to stop the flow of liquid. As the liquid level rises in a bottle, the liquid contacts a float which is lifted via a buoyant force when the liquid reaches a certain level. This lifting effect may be coupled to a valve which shuts off the flow of liquid, thus ending the filling operation for a bottle. In other embodiments, a bottle may rest on a device (e.g., a scale, etc.) capable of measuring weight during the filling process. The controller 80 reads the scale during the filling process and shuts of the liquid flow when the scale reads at or above a certain weight, indicating the bottle is full.

In other embodiments, the controller 80 may be configured to open a valve for a particular duration of time to fill a bottle. The particular amount of time is selected such that a bottle will be at a proper fill level after the valve has been open and liquid flowing for that duration. This method may also incorporate a pressure regulator for the liquid enabling it to flow at a constant rate. In other embodiments, the apparatus 10, 200 (FIG. 32), and 300 (FIG. 33) may be designed to overfill bottles with a liquid. Excess liquid is allowed to spill out of the bottles where it may be collected into a drain or reservoir. This may be accomplished by any of the above (or other) filling methods.

Bottle Capping

Figure 14:
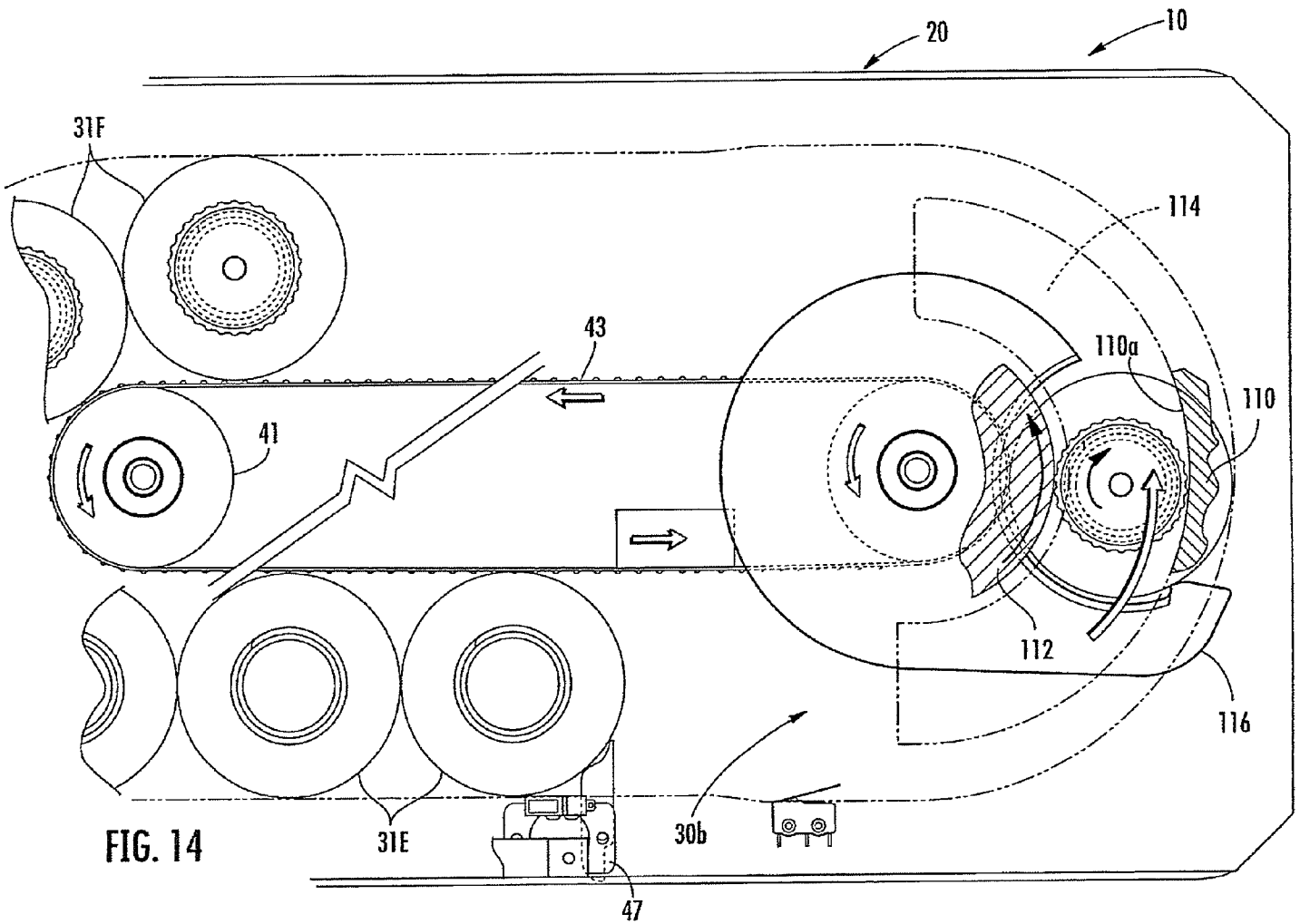
Figure 15:
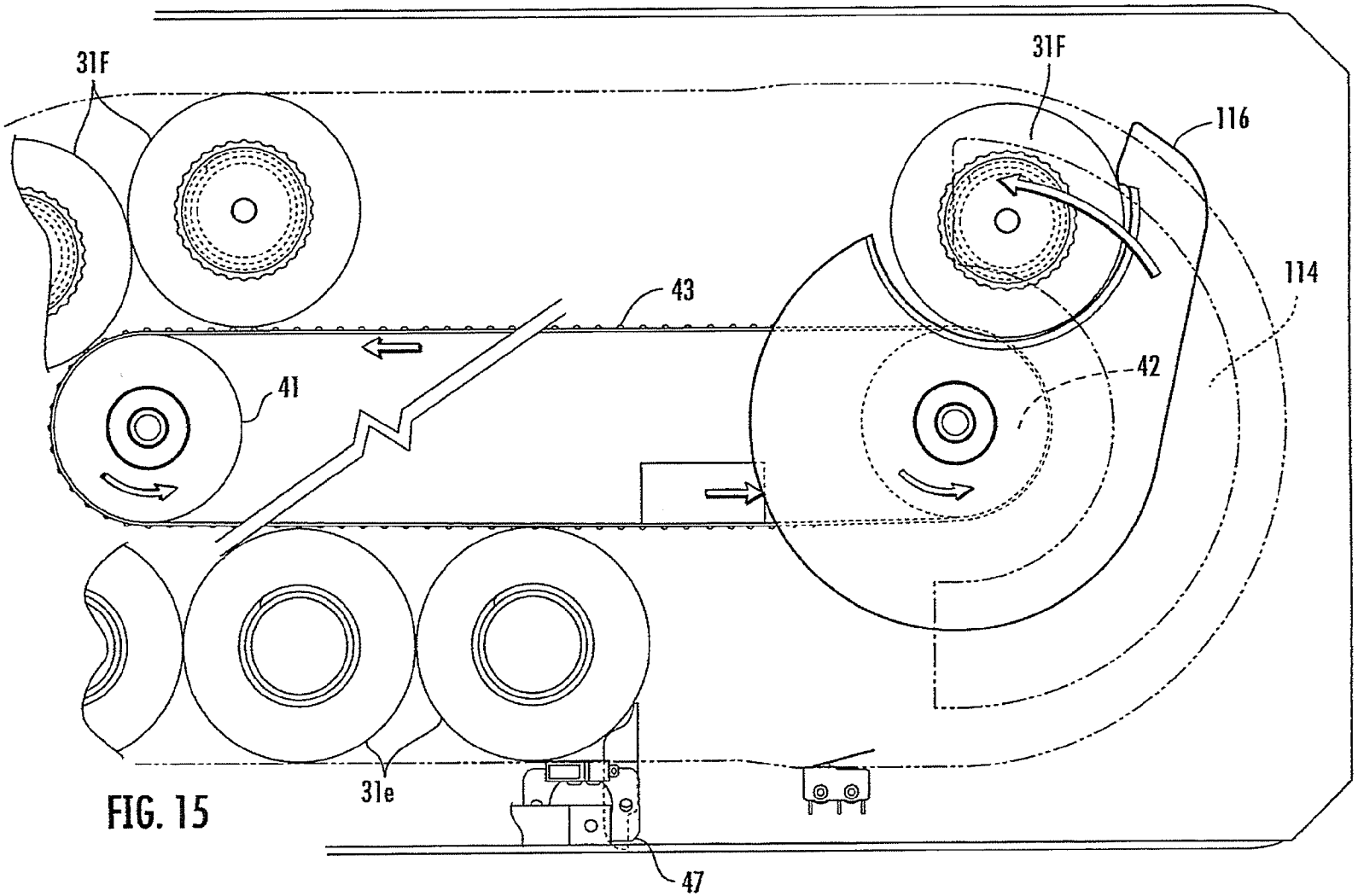
Figure 16:
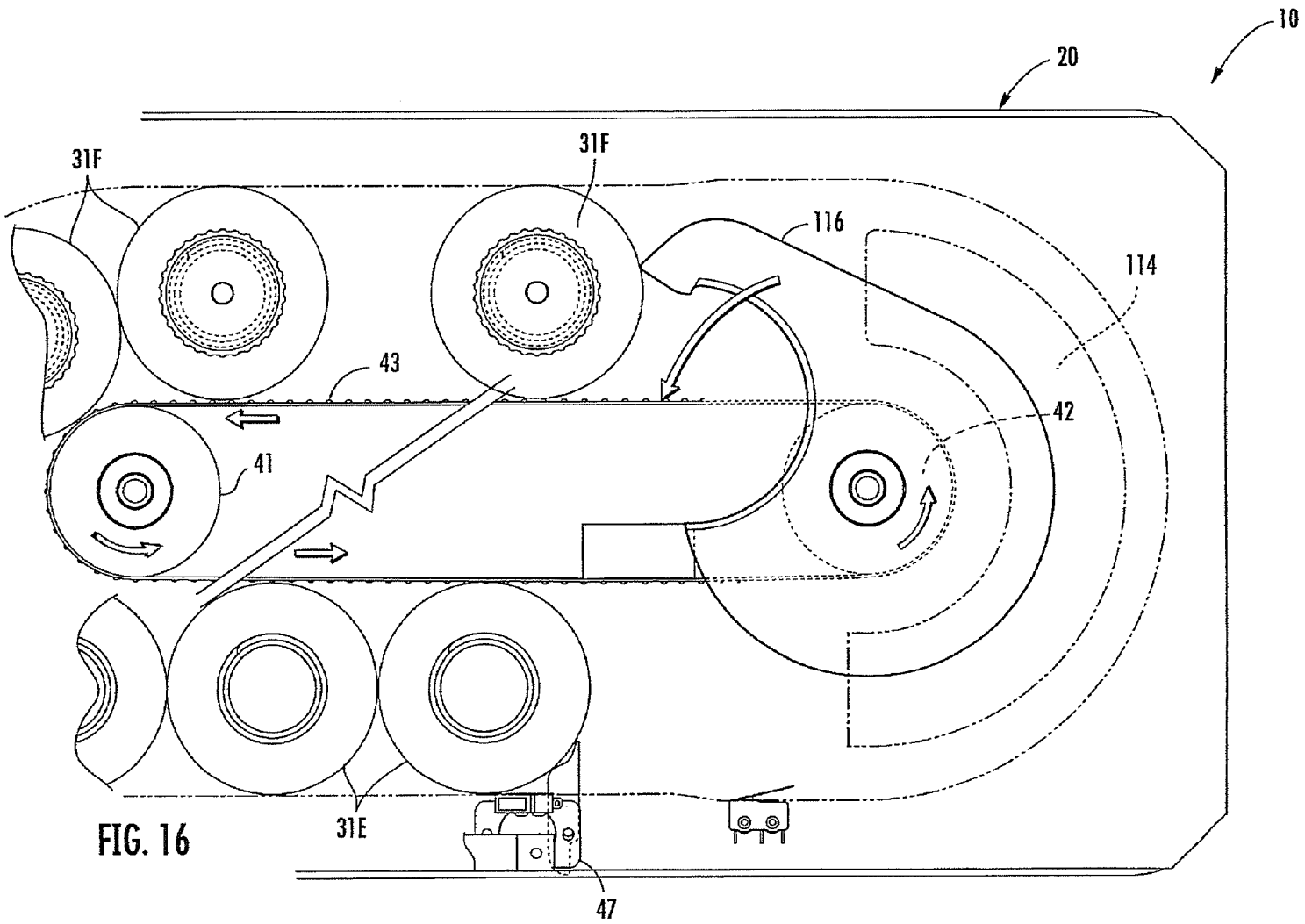
Figure 17:
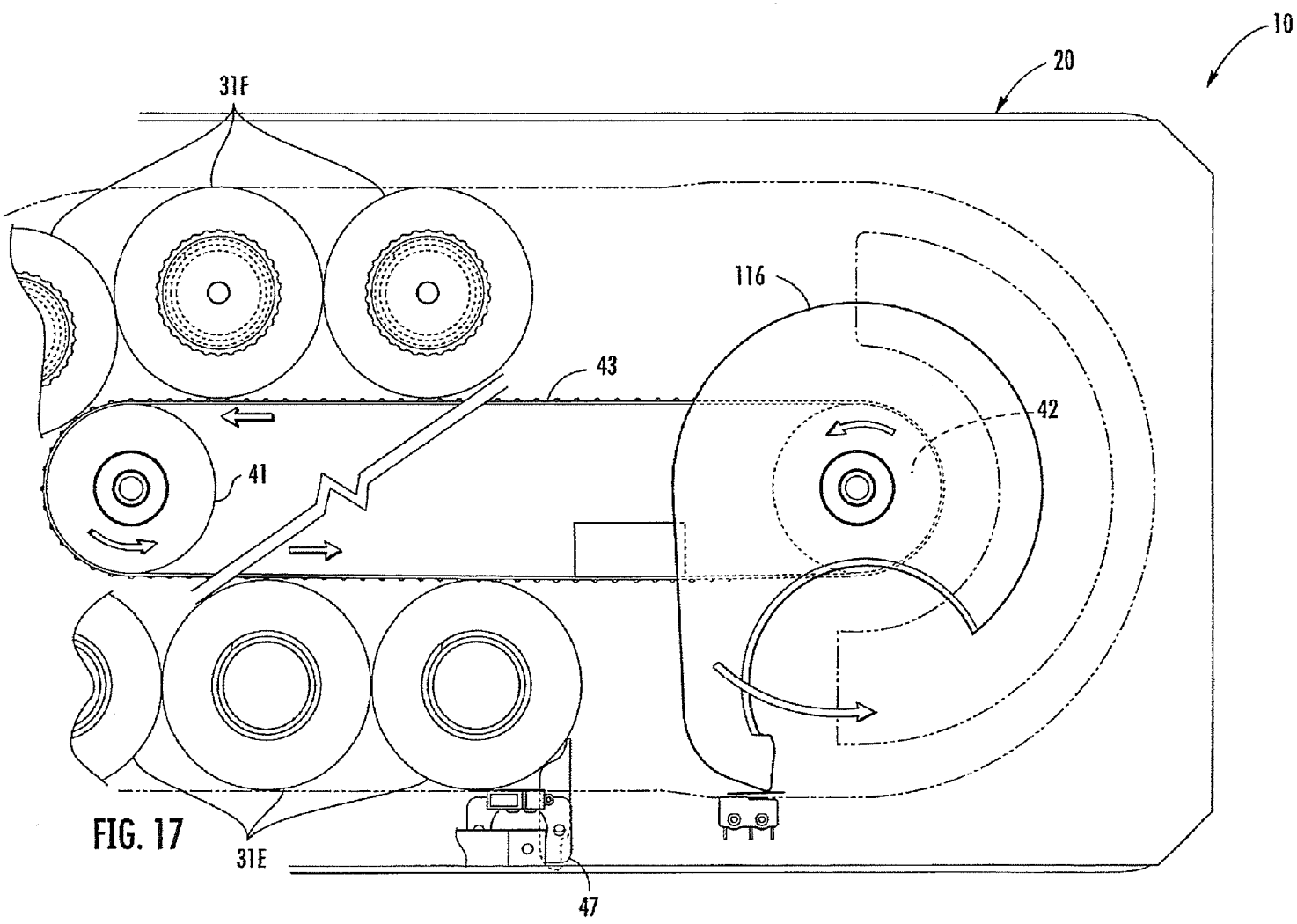
Figure 18:
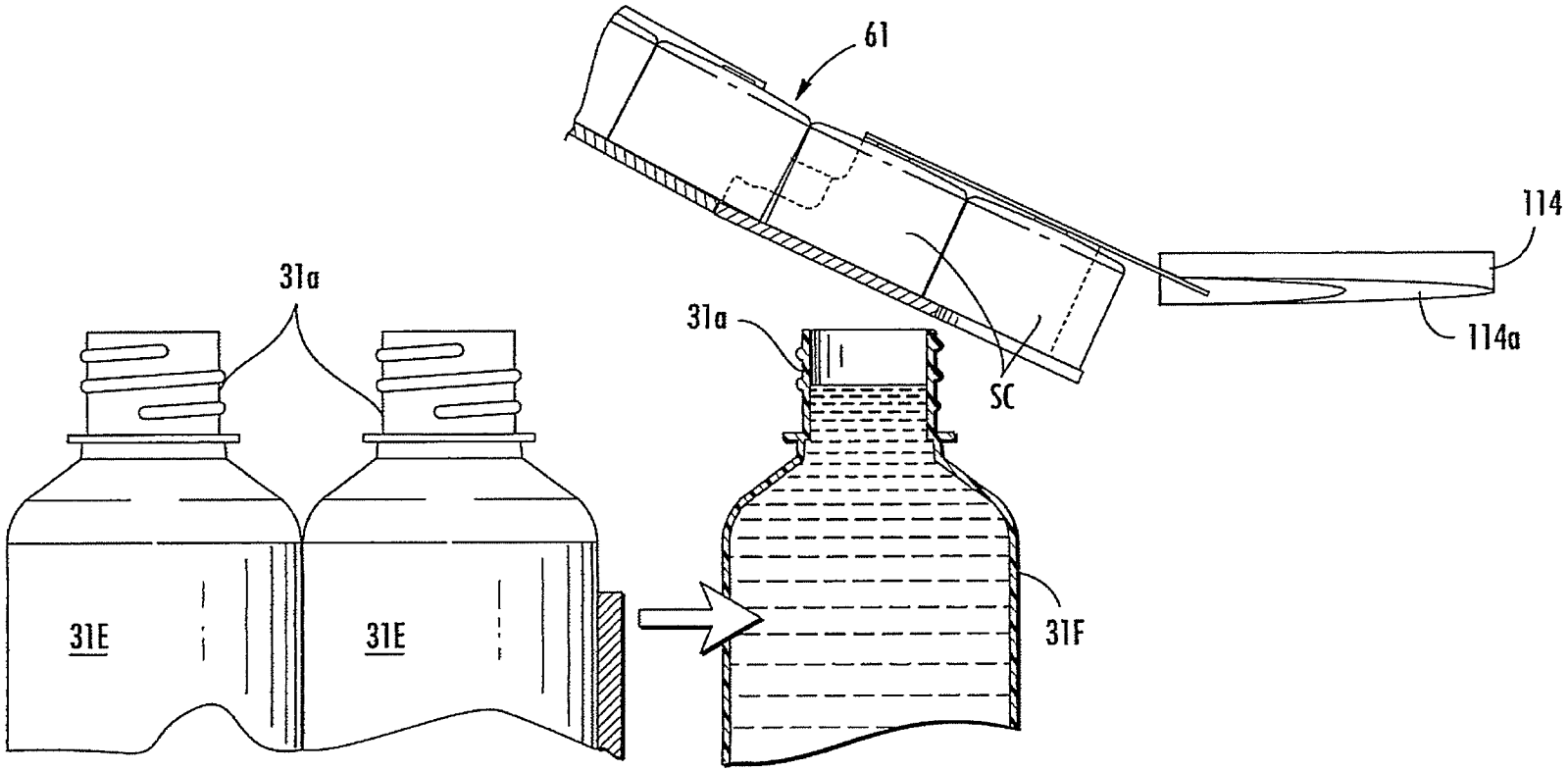
FIGS. 18-22 are partial side elevation views of the water bottle filling apparatus of FIG. 3 illustrating sequential operations for capping a filled bottle, according to some embodiments of the present invention.

The bottle capping station 60 includes the screw cap dispenser 61, described above, along with an arcuate wall 110, a rotatable wheel 112, a guide panel 114, and a rotatable gripper arm 116. The arcuate wall 110 is positioned above the conveying path 30 downstream from the dispenser outlet 65, as illustrated in FIGS. 4 and 14. In some embodiments, the arcuate wall surface 110*a* has tactile material (e.g., rubber or other soft polymeric material, etc.) that resists slippage of a screw cap SC in contact therewith. The rotatable wheel 112 is positioned above the conveying path downstream from the dispenser outlet in spaced-apart, substantially concentric relationship with the arcuate wall 110, as illustrated in FIG. 1. The rotatable wheel 112 is a free-spinning disk. The rotatable gripper arm 116 is operatively coupled to the motor shaft 46 and is configured to engage a filled bottle 31F located under the dispenser outlet 65 having a screw cap SC thereon and move the bottle 31F along the conveying path 30 a predetermined distance. The guide panel 114 is positioned above the conveying path second end 30*b*, as illustrated in FIG. 14. The guide panel 114 also has an inclined surface 114*a* that is configured to engage the upper surface of a screw cap SC and to apply downward pressure on the screw cap SC as a bottle is moved along the predetermined distance. The guide panel 114 also has an arcuate configuration, as illustrated in FIG. 14.

Figure 21:
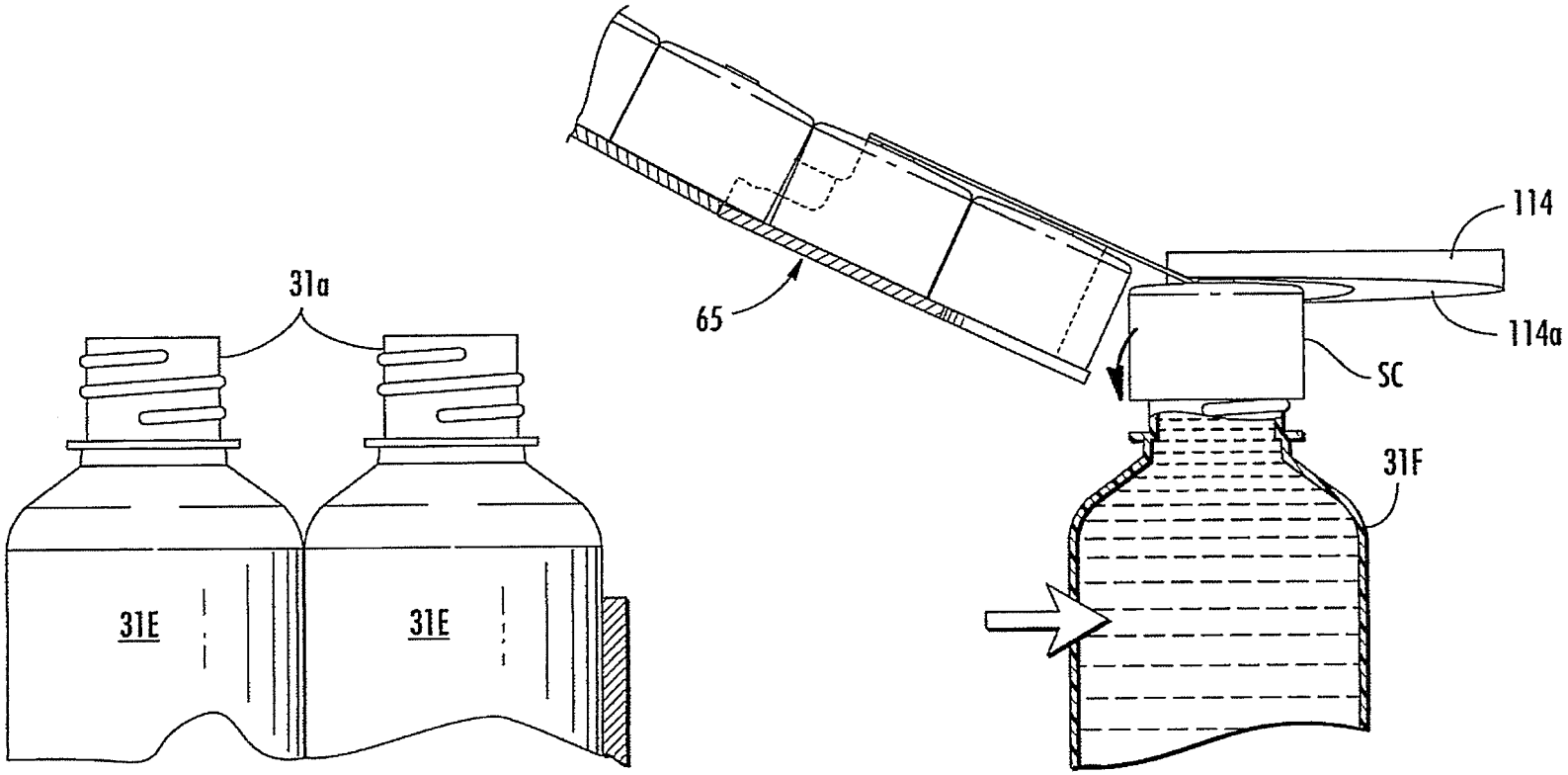
Figure 22:
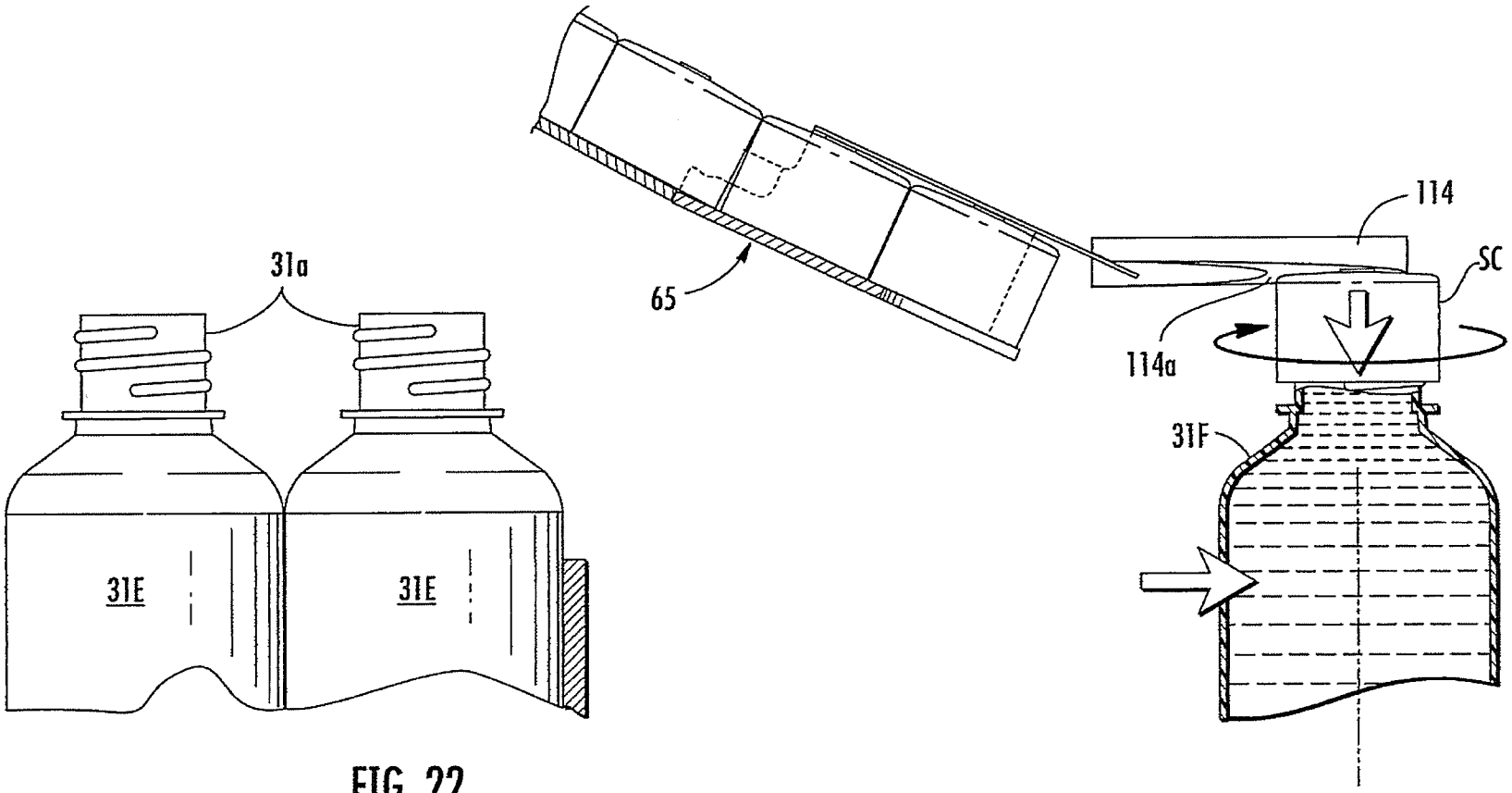

As a filled bottle 31F leaves the filling station 50, the bottle transitions from the endless belts 43 to the gripper arm 116. The gripper arm 116 moves the filled bottle 31F under the screw cap dispenser outlet 65, and this motion results in a screw cap SC being loosely placed on the mouth of the filled bottle 31F (FIGS. 11-13 and 19-20). As the filled bottle 31F is moved along the predetermined arcuate distance, the inclined surface 114*a* of the guide panel 114 exerts downward pressure on the top of the screw cap SC, ensuring that the screw cap SC will engage the threads on the bottle mouth 31*a* (FIGS. 21-22). In some embodiments, the guide panel 114 may be biased downwardly, for example via a spring, to maintain downward pressure on the top of a screw cap SC.

As the gripper arm 116 moves the filled bottle 31F along the predetermined distance, the screw cap SC positioned on the bottle mouth 31*a* frictionally engages the arcuate wall surface 110*a* and the rotatable wheel 112 (i.e., the screw cap SC is squeezed slightly by the arcuate wall surface 110*a* and wheel 112) and rotates relative to the bottle so as to become threadingly engaged with the bottle mouth 31*a* (FIG. 14). As the bottle moves around the path along the predetermined distance, the bottle 31F does not rotate as it is held by the gripper arm 116, illustrated in FIG. 22). The predetermined distance that the filled bottle 31F is moved by the gripper arm 116 is sized so that a sufficient number of screw cap rotations occur to ensure tight screw cap application to the mouth of the bottle. The capped bottle then transitions out of the gripper arm and back to the conveying path where the endless belts 43 can continue moving the bottle along the conveying path.

Figure 6:
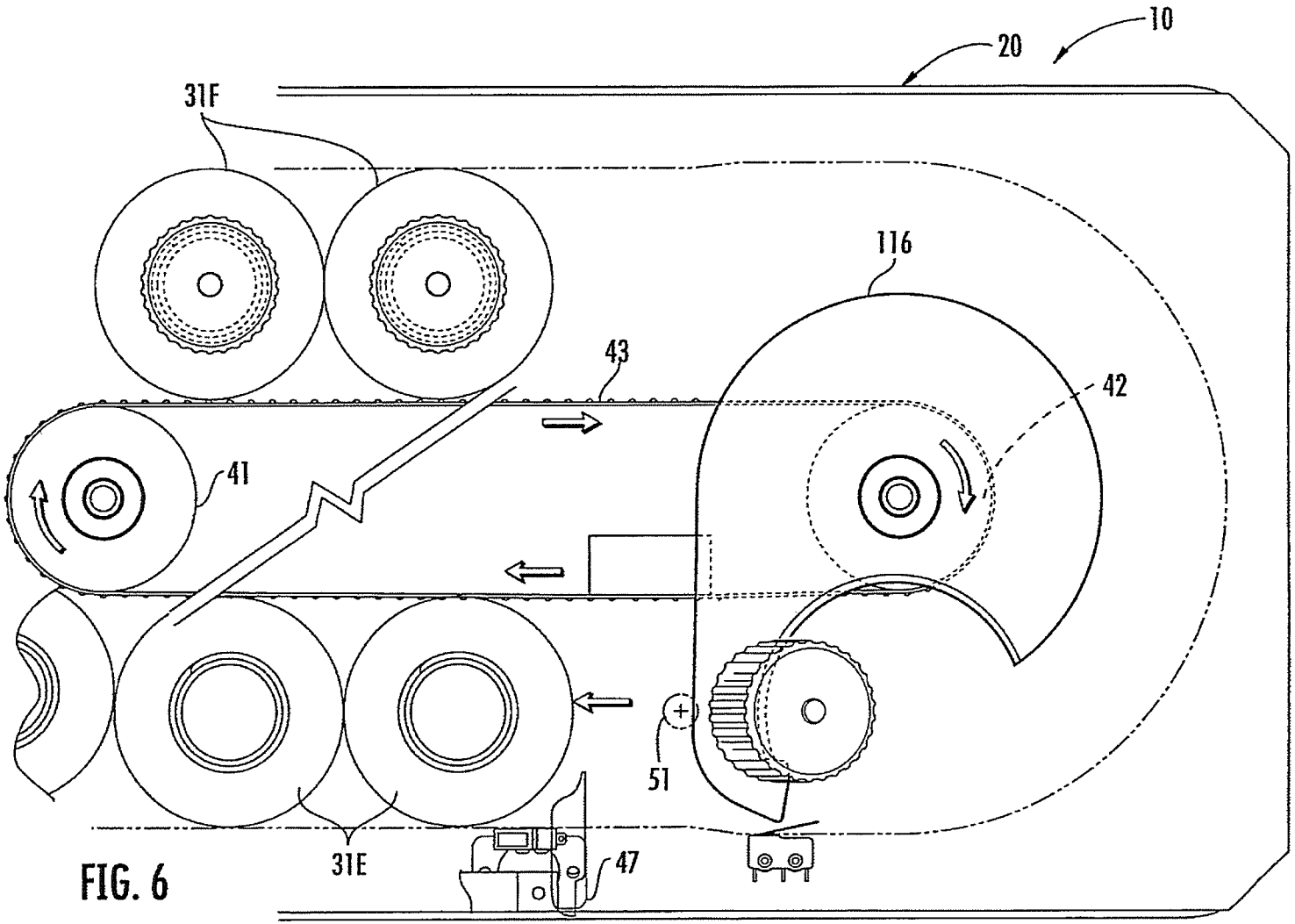

The sequence of filling and capping operations are illustrated in FIGS. 5-17. In FIG. 5, an empty bottle 31E is held by the gate 47. Prior to positioning the empty bottle 31E under the nozzle 51, the conveying system 40 reverses the direction of the endless belts 43 such that the empty bottle 31E and other bottles in the conveying path 30 are moved slightly clockwise (FIG. 6). This action serves to move the bottle to be filled out of contact with the gate 47, thus eliminating any sideward or normal force on the gate 47 which causes excess friction on the gate release mechanism. By performing this "unload" move, the gate release actuator size can be minimized to reduce cost and power consumption.

Figure 7:
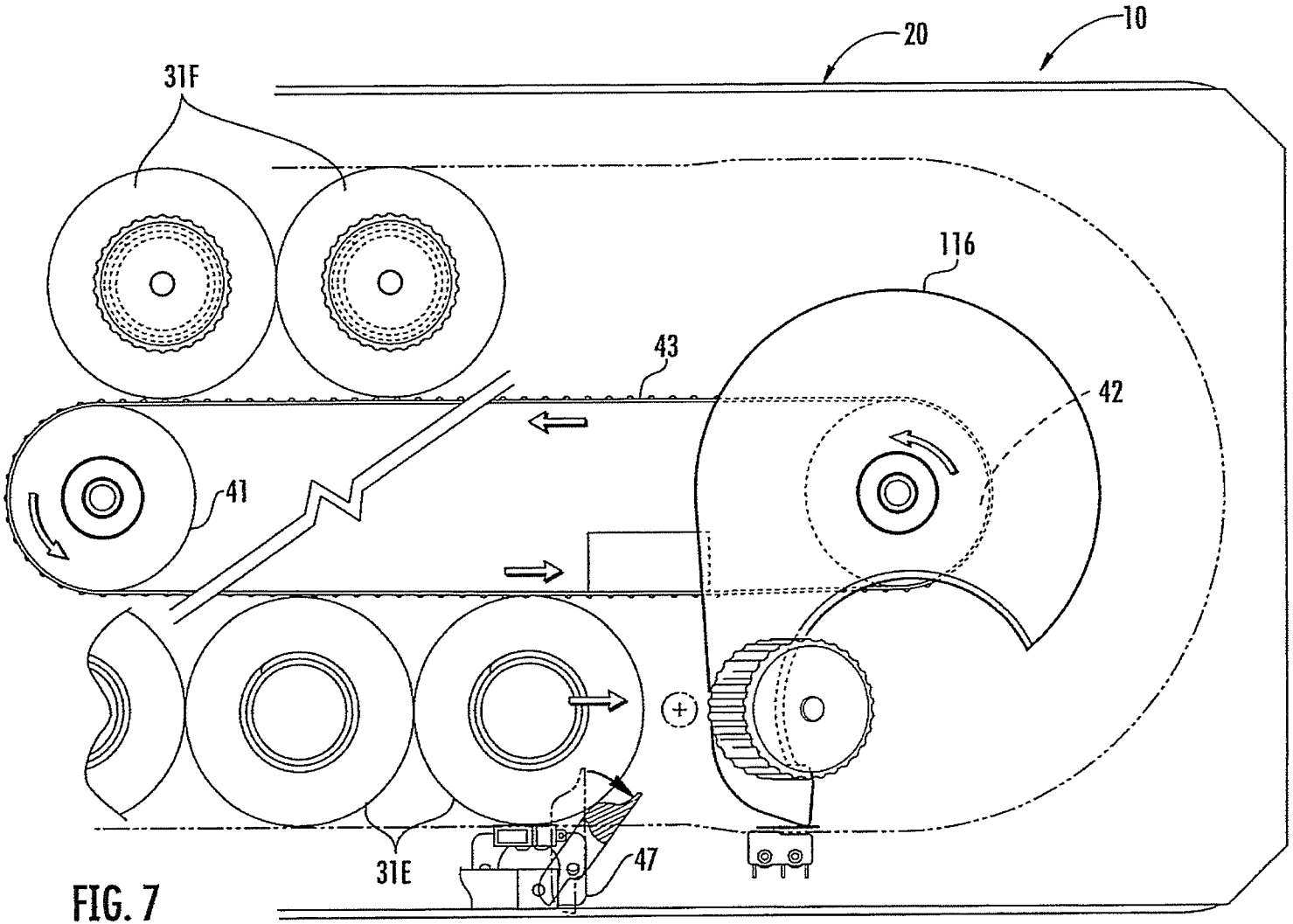
Figure 8:
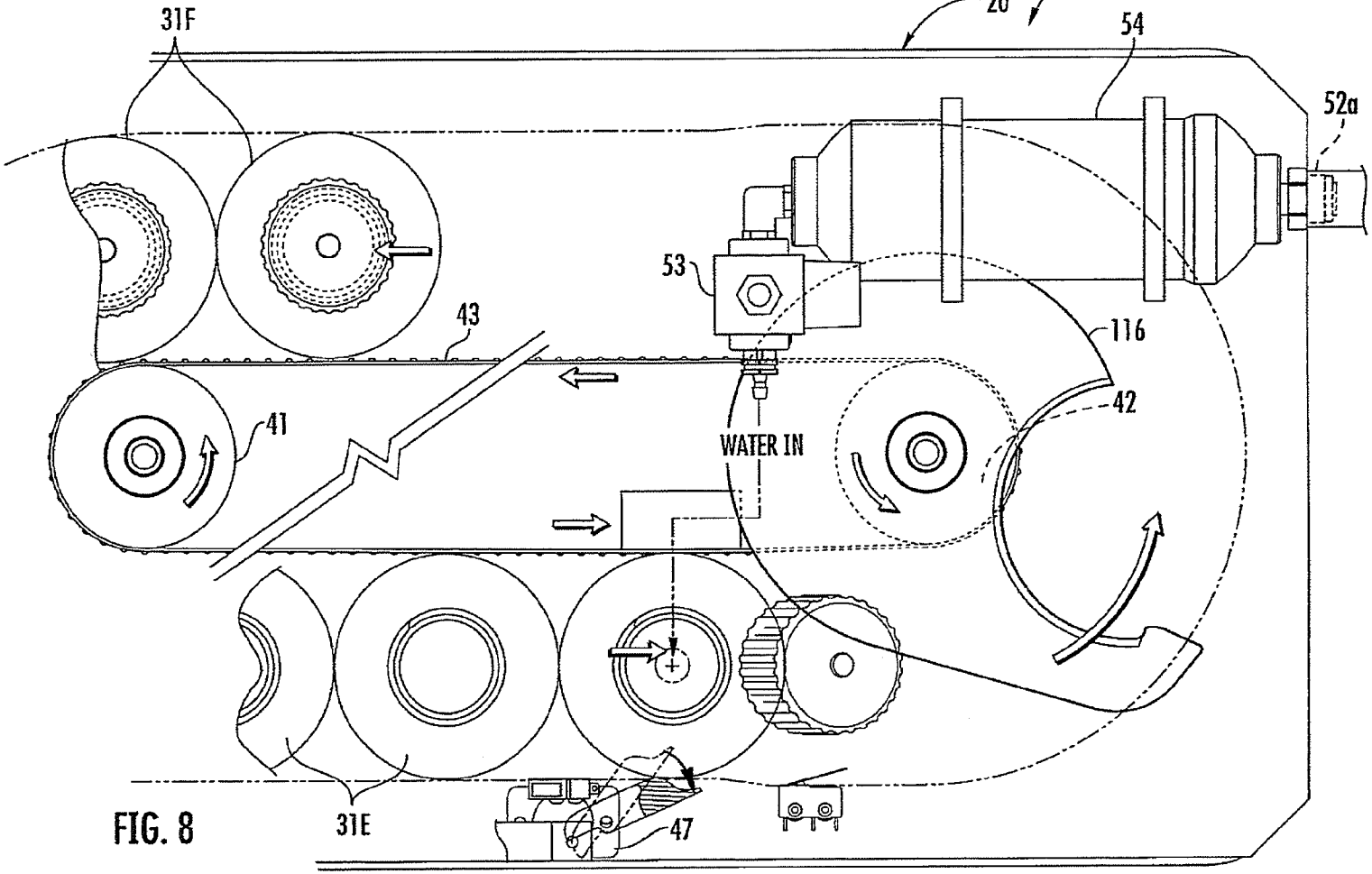
Figure 9:
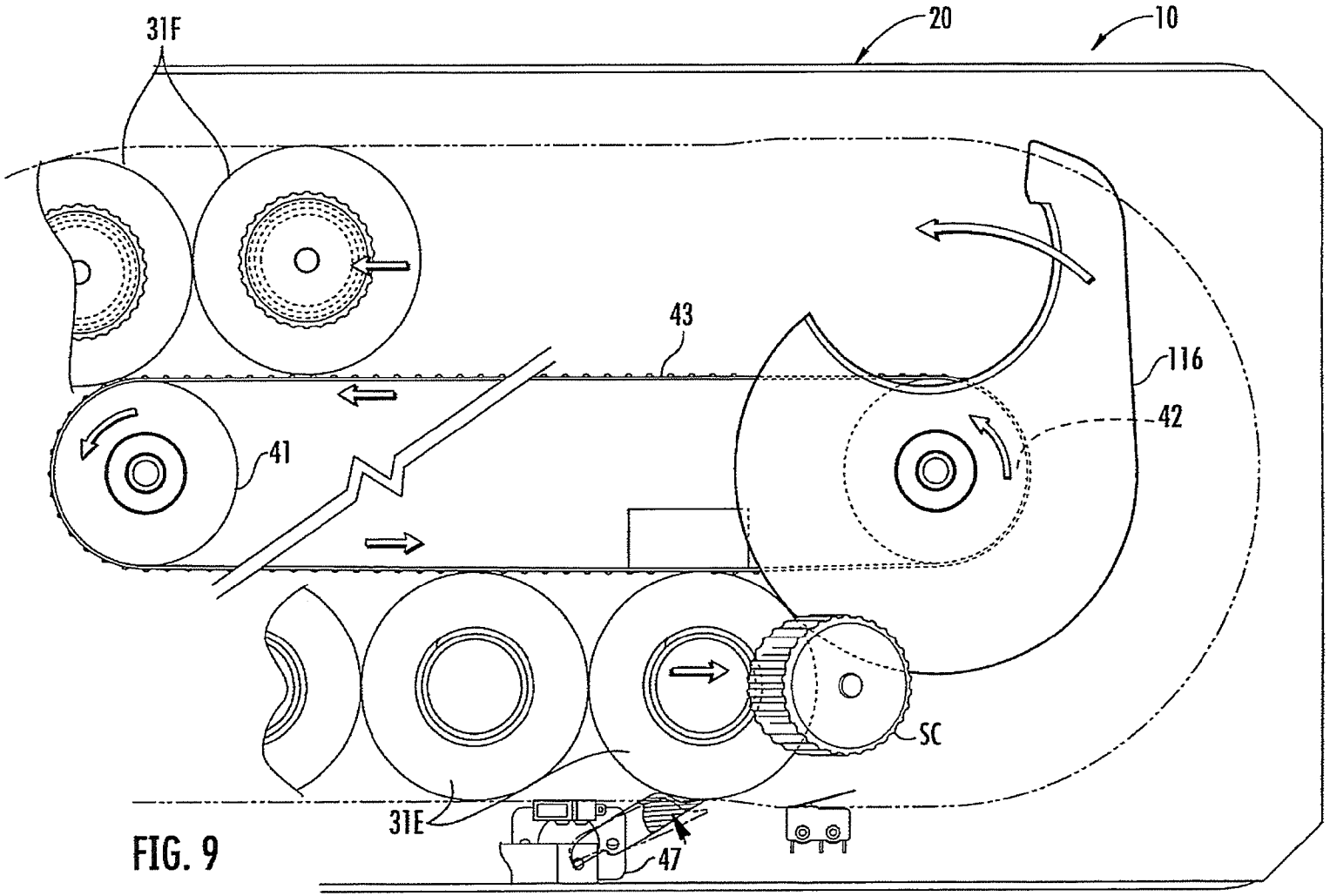
Figure 10:
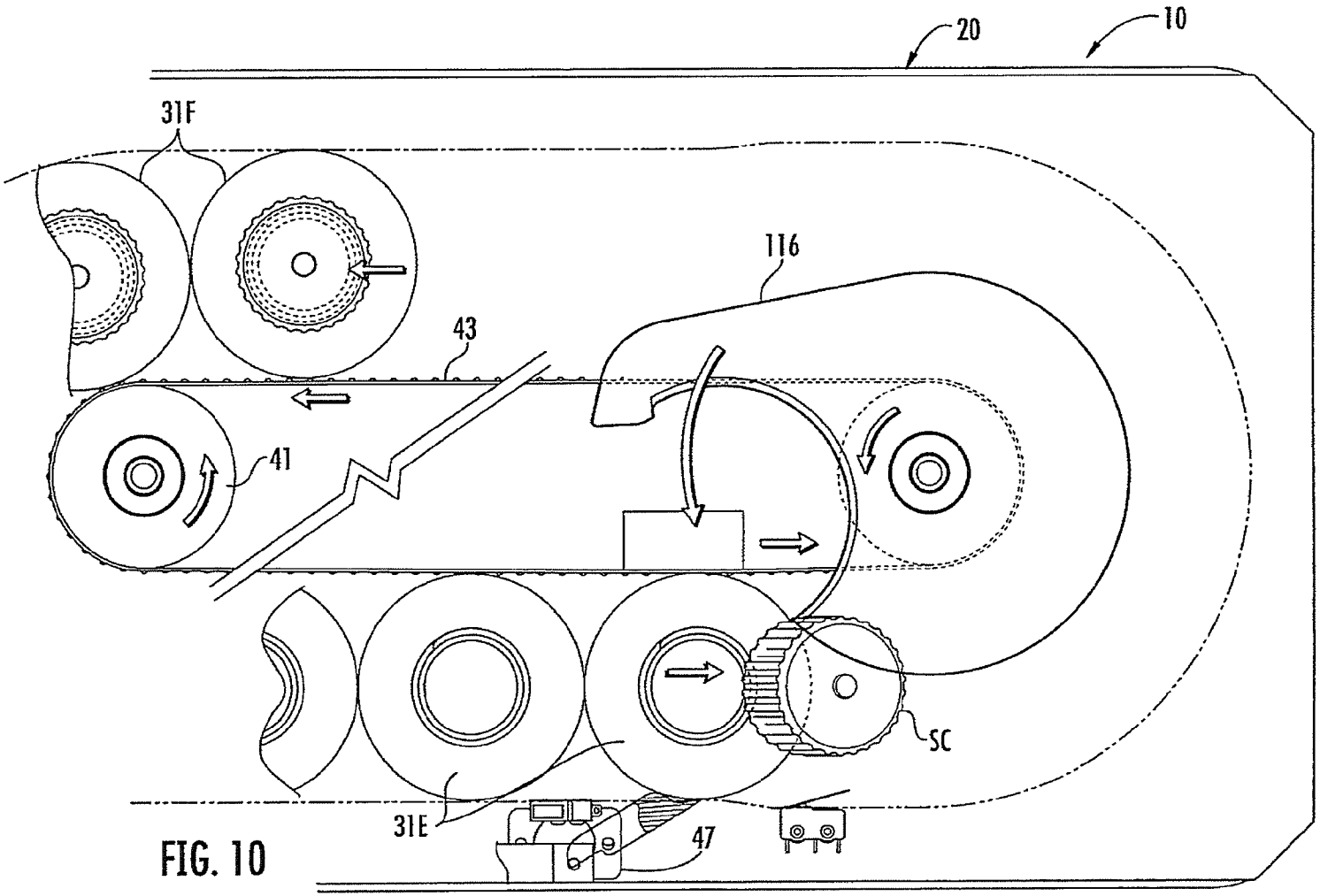
Figure 11:
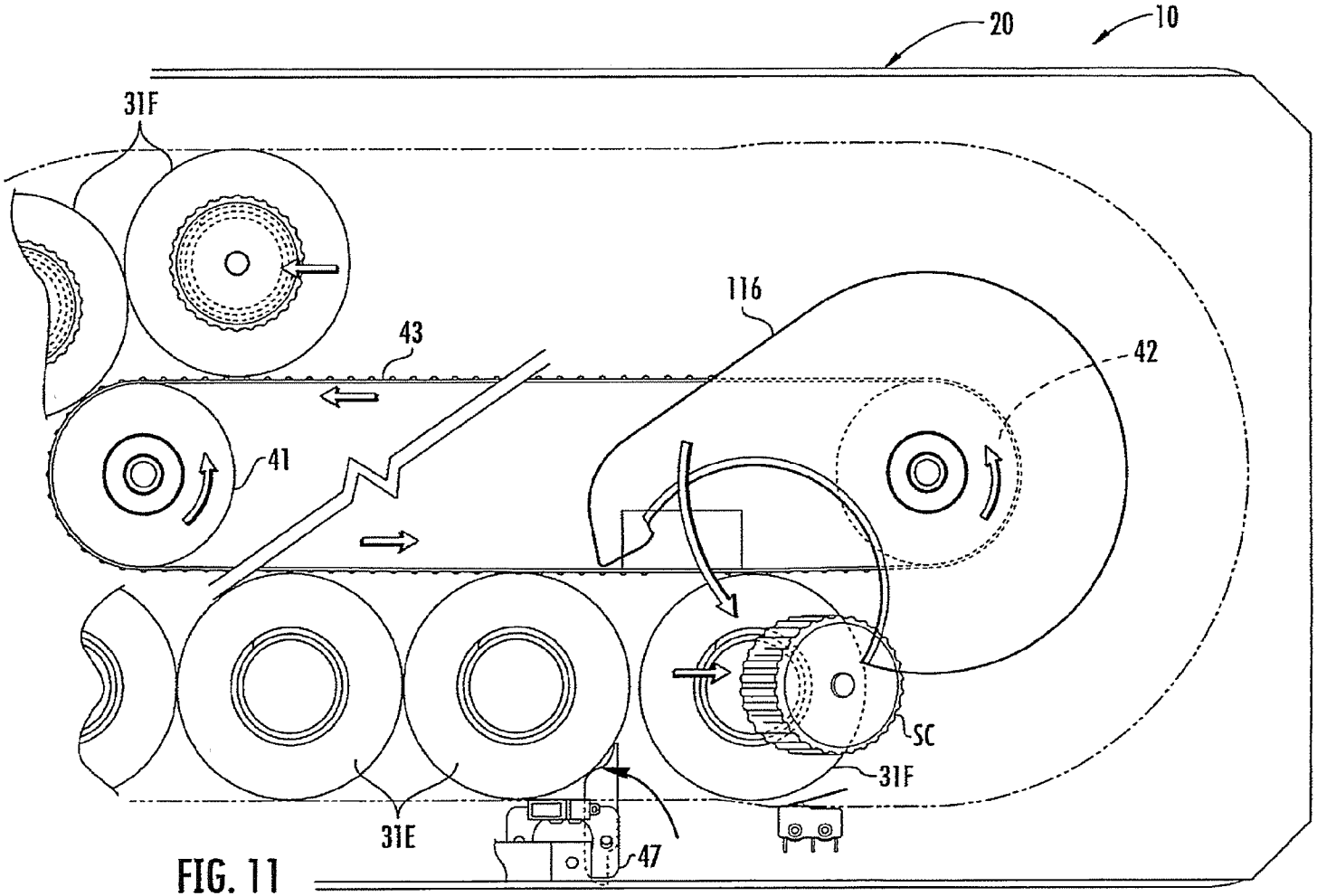
Figure 12:
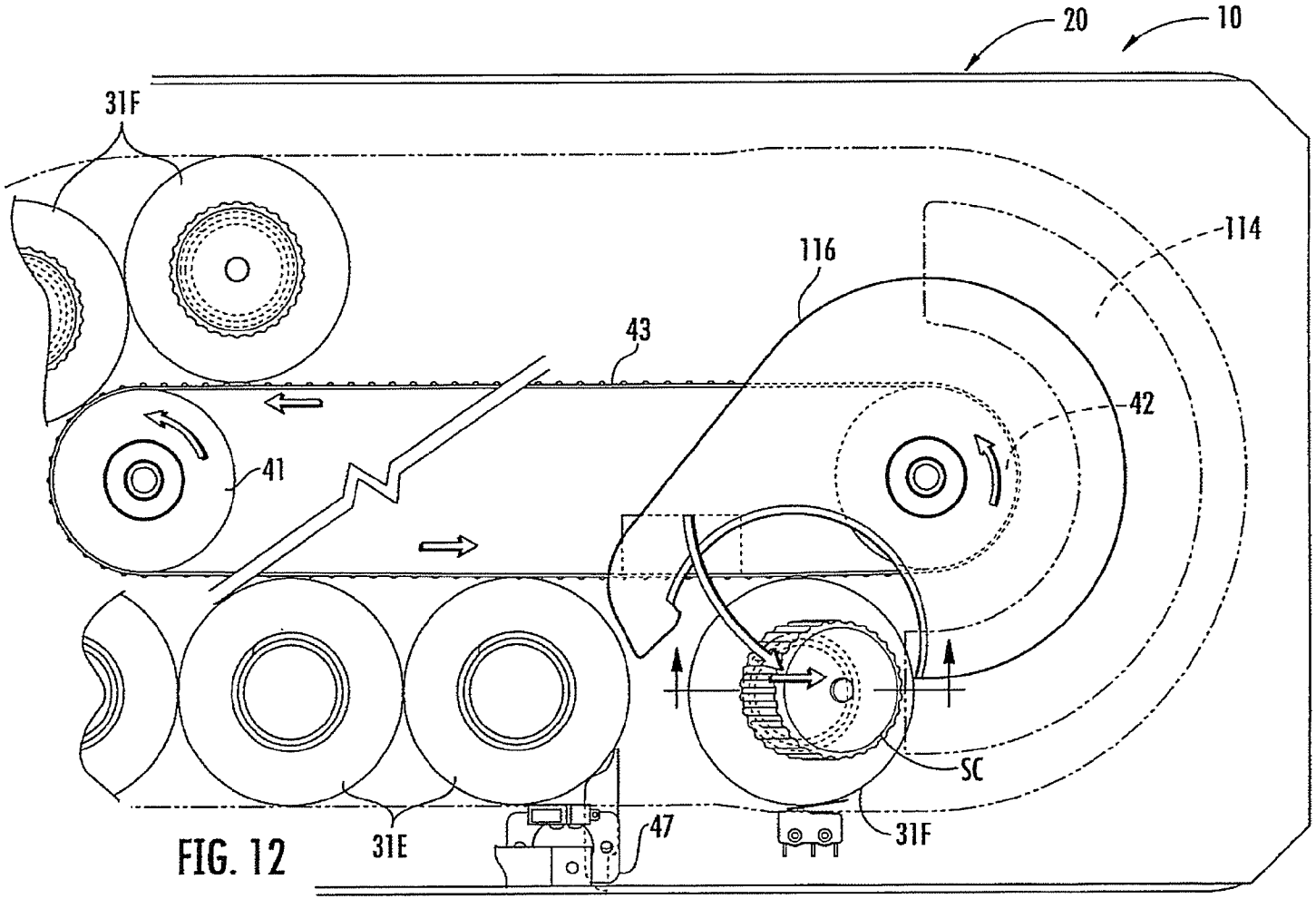
Figure 13:
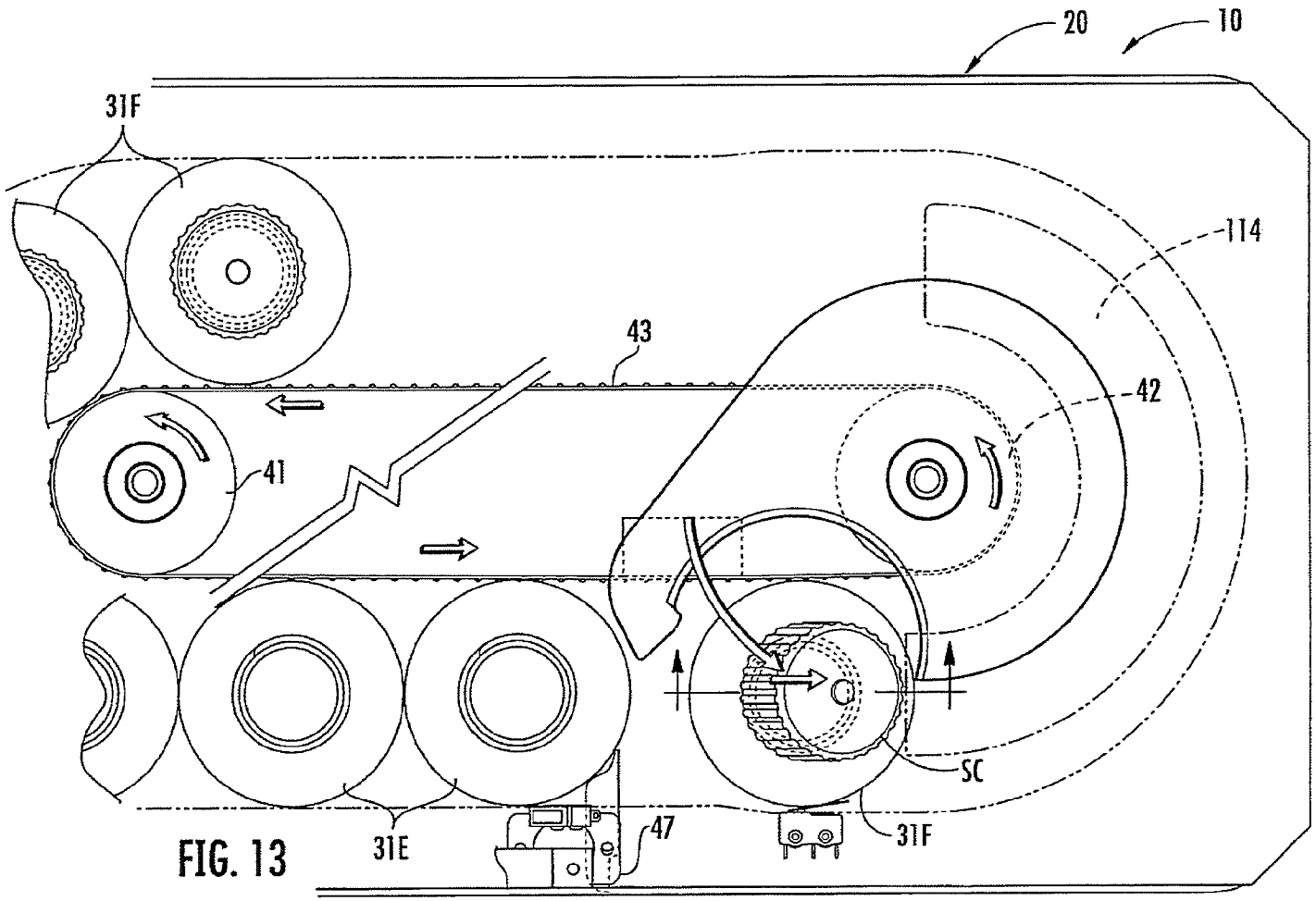

The conveying system 40 then reverses the direction of the endless belts 43 and the gate 47 is opened to permit the empty bottle 31E to advance to a position directly under the nozzle 51 (FIGS. 7-8). The empty bottle 31E is filled as described above, and then is advanced by the endless belts as the gripper arm 116 rotates into position to grip the bottle (FIGS. 9-12). After the filled bottle 31F is advanced a sufficient amount, the gate 47 closes to prevent any further advances by other bottles on the conveying path 30 until the gripper arm 116 moves the recently filled bottle 31F along the predetermined distance to threadingly engage the screw cap SC onto the mouth of the recently filled bottle 31F (FIGS. 11-17).

Controller

Referring back to FIG. 2, the a controller 80 controls operations of the water filling station 50, capping station 60 and conveyor system 40 in response to signals received from the sensor system 70. The controller 80 can be a conventional programmable controller and/or can include an application specific integrated circuit (ASIC) configured to control operation of the respective components of the apparatus 10, or a general microprocessor or controller (e.g. computer).

The controller 80 contains a control program (firmware, software, etc.) that dictates the operation of the automatic water bottle filling and capping apparatus 10. The controller 80 monitors the status of the various sensors, including the bottle/cap sensor 74 and also system sensors such as access door open/close status and gripper position, in order to automatically control operation of the apparatus 10. For example, the controller 80 can automatically re-assess system status when the access door sensor indicates the door 14 has changed state from opened to closed. By controlling the apparatus 10 in this way, no additional user actions or other input is required to start or stop the filling process, thereby maximizing convenience for the user. Additionally, the controller 80 ensures proper operation, for example by ensuring liquid is only dispensed into a properly positioned bottle (as indicated by the sensors), eliminating spillage, and ensures safe operation by halting operation if the access door 14 is opening during processing, and then re-assessing status after door closing and resuming normal operation.

Figure 32:
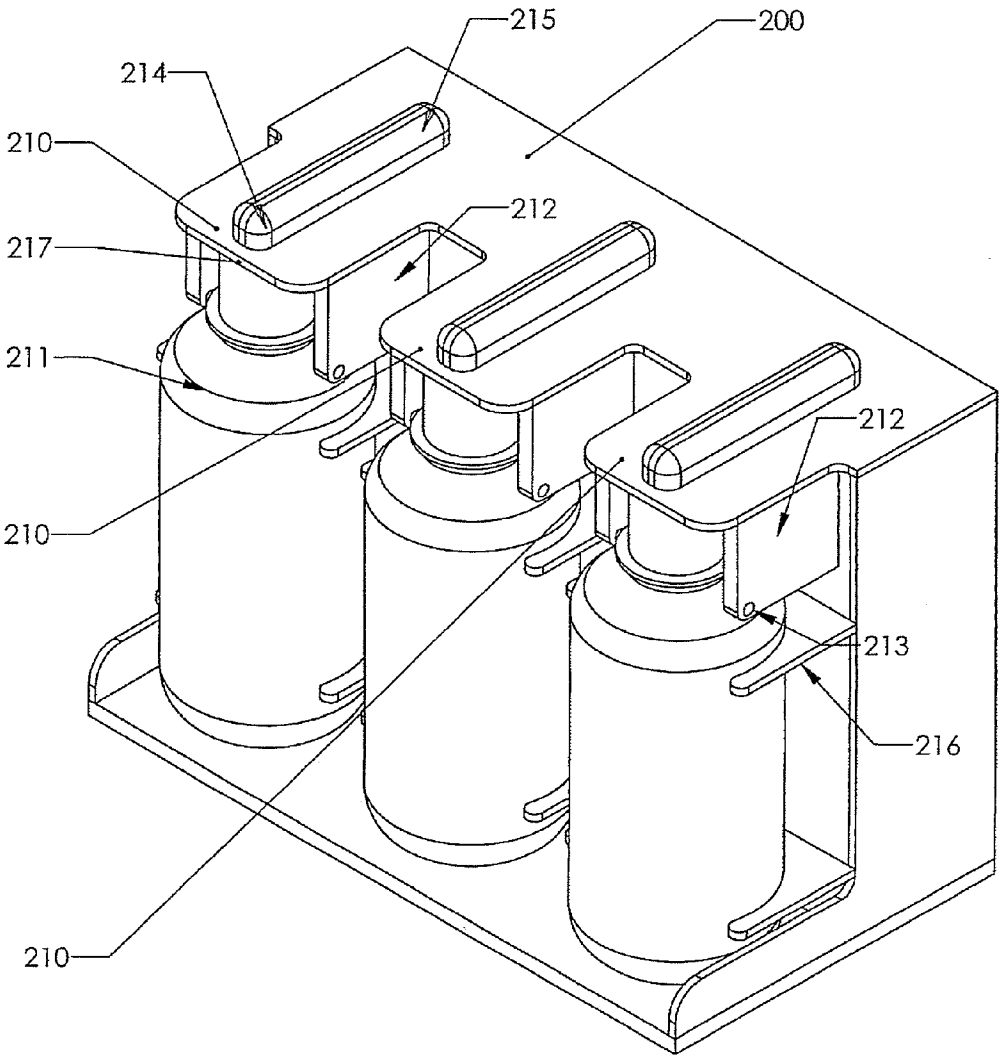
FIG. 32 is a top perspective view of a portable, automatic water bottle filling apparatus, according to other embodiments of the present invention.

Referring now to FIG. 32, an apparatus 200 for automatically filling water bottles, according to other embodiments of the present invention, is illustrated. The illustrated apparatus 200 includes one or more filling stations 210 into which bottles 211 are manually placed by a user and automatically filled for retrieval at a later time. Each filling station 210 includes a sensor 212 for detecting the presence of a bottle, and a sensor 213 for detecting fill level. Each filling station 210 also includes a filling port 214 which delivers liquid into a bottle 211, a valve 215 for controlling liquid flow to the filling port 214, and mechanical support arms 216 to aid in the proper positioning of a bottle 211. The valve 215 is connected to a liquid source which may include a filter or purification system.

The apparatus 200 operates as follows: a controller (such as controller 80 of FIG. 2) monitors the bottle presence sensors 212 of each filling station 210 for an indication that an empty bottle has been placed therein for filling. Upon determining an empty bottle is present, the controller activates the valve 215 associated with the particular filling station 210 to fill the bottle. Once the fill sensor 213 indicates a bottle is full, the valve 215 is closed and filling is complete. At this point the station remains idle until the filled bottle is removed and replaced with an empty bottle. The apparatus 200 does not apply a cap to the bottle; however, the bottle opening is protected from contamination by a closely located horizontal wall 217. An optional capping station, however, may be provided, according to some embodiments of the present invention.

Figure 33:
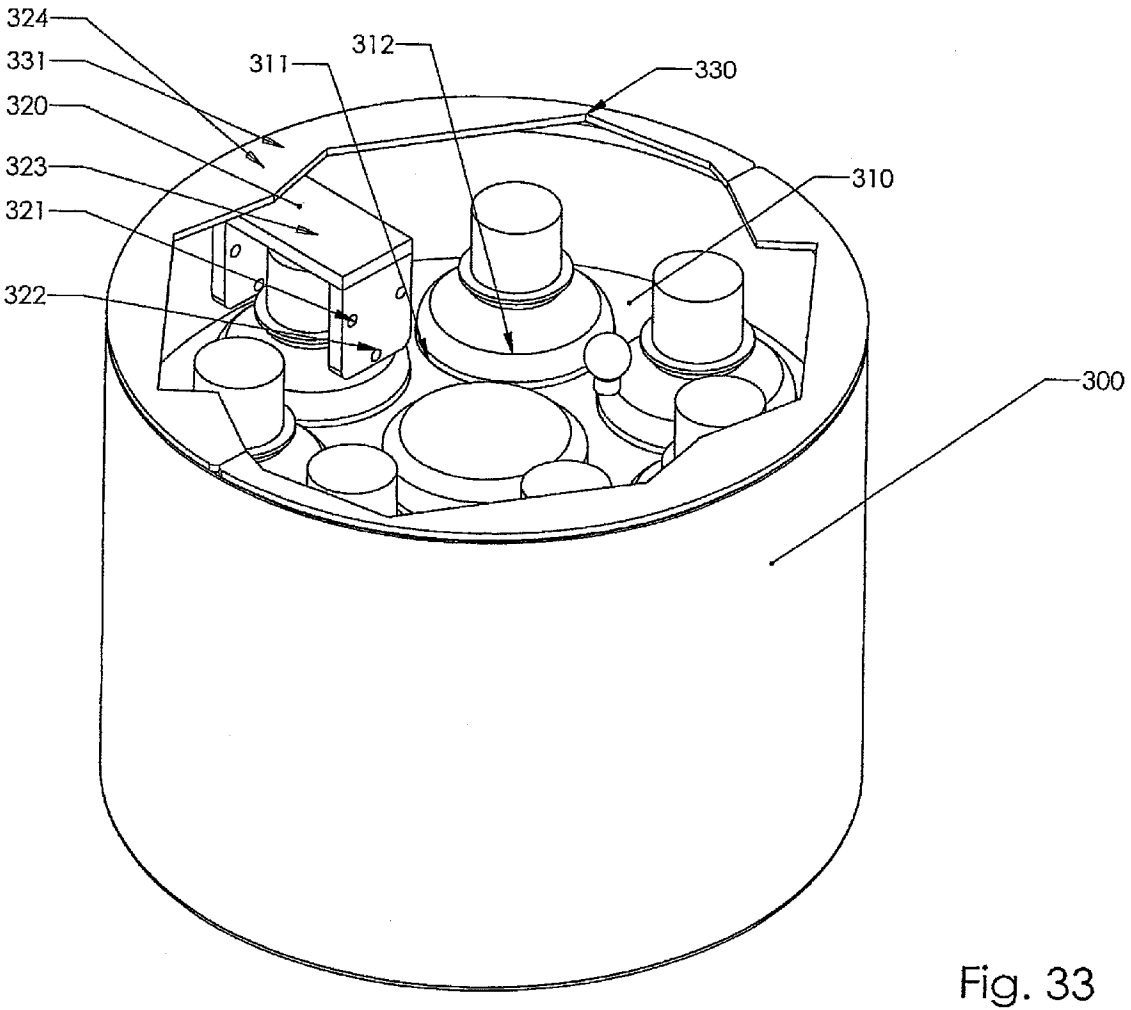
FIG. 33 is a top perspective view of a portable, automatic water bottle filling apparatus, according to other embodiments of the present invention.

Referring now to FIG. 33, an apparatus 300 for automatically filling multiple bottles, according to other embodiments of the present invention, is illustrated. The illustrated apparatus 300 includes a rotary drum 310 which contains multiple receptacles 311, each of which is configured to hold a single bottle 312. The drum 310 is rotatable about a center pivot, and may be actuated by a motor or indexing mechanism (not shown), as would be understood by one skilled in the art of the present invention. The motion of the drum 310 is controlled such that a bottle receptacle 311 will be located directly under the filling station 320. The filling station 320 includes a sensor 321 for detecting the presence of a bottle and a sensor 322 for detecting liquid fill level. The filling station 320 also includes a filling port 323 which delivers liquid into the bottle, and a valve 324 for controlling liquid flow to the filling port 323. The valve 324 is connected to a liquid source which may include a filter or purification system. The apparatus 300 includes a cover 330 (shown in fragmentary view) and a cover sensor 331.

The apparatus 300 operates as follows: upon closing of the cover 330, the drum 310 is indexed (i.e., rotated) to the next position and the sensor 321 is checked for the presence of an empty bottle. Upon determining an empty bottle is present, the controller (such as controller 80 of FIG. 2) activates the valve 324 to fill the bottle. Once the fill sensor 322 indicates a bottle is full, the valve 324 is closed and filling is complete. The controller may now index the drum 310 to the next position and perform the same operation. This operation continues until no empty bottles are left. The illustrated apparatus 300 does not apply a cap to the bottle; however, the bottle opening is protected from contamination via the cover 330. An optional capping station, however, may be provided, according to some embodiments of the present invention.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A portable, automatic bottle filling apparatus, comprising:

an elongated frame that defines an endless conveying path;

a conveyor system that moves bottles along the conveying path;

a liquid filling station adjacent to the conveying path that is configured to fill an empty bottle with liquid from a liquid source;

a capping station positioned downstream from the liquid filling station that is configured to close a filled bottle with a cap;

a sensor system configured to detect the presence of an empty bottle at the liquid filling station and to detect the presence of a cap on a bottle at the liquid filling station; and a controller that controls operations of the liquid filling station, capping station and conveyor system in response to signals received from the sensor system.

2. The bottle filling apparatus of claim 1, wherein the frame is enclosed within a housing, and wherein the housing comprises an access door movable between closed and opened positions to provide access to the conveying path.

3. The bottle filling apparatus of claim 1, wherein the frame comprises:

a floor; and at least one panel vertically spaced from the floor and substantially parallel therewith;

wherein the at least one panel has an opening formed therein that at least partially defines the conveying path, wherein bottles supported on the floor in an upright position are movable along the conveying path.

4. The bottle filling apparatus of claim 1, wherein the conveyor system comprises:

a friction drive pulley supported by the frame adjacent to a conveying path first end;

a belt drive pulley supported by the frame adjacent to a conveying path second end;

an endless belt extending about the friction drive and belt drive pulleys, wherein the endless belt is configured to frictionally engage bottles in the conveying path; and a motor assembly supported by the frame, the motor assembly including a motor and motor shaft that is rotatably driven by the motor, wherein the belt drive pulley is operatively coupled to the motor shaft, and wherein rotation of the belt drive pulley via the motor causes the endless belt to move and thereby convey bottles along the conveying path.

5. The bottle filling apparatus of claim 4, wherein the conveyor system is configured such that the endless belt frictionally engages bottles adjacent the conveying path second end with a greater force than bottles adjacent the conveying path first end.

6. The bottle filling apparatus of claim 1, wherein the liquid filling station comprises:

a nozzle positioned above the conveying path; and a conduit coupled at an inlet with the liquid source and at an outlet with the nozzle, wherein the conduit comprises a valve configured to control the flow of liquid through the nozzle from the liquid source.

7. The bottle filling apparatus of claim 6, wherein the conduit comprises a filter.

8. The bottle filling apparatus of claim 1, wherein the capping station comprises:

a screw cap dispenser supported by the frame and positioned above the conveying path, wherein the dispenser comprises an outlet configured to releasably retain a screw cap therein such that the mouth of a bottle moving along the conveying path from the liquid filling station makes contact with the screw cap and causes the outlet to release the screw cap onto the bottle mouth;

an arcuate wall positioned above the conveying path downstream from the dispenser outlet;

a rotatable wheel positioned above the conveying path downstream from the dispenser outlet in spaced-apart relationship with the arcuate wall; and a rotatable gripper arm configured to engage a bottle located under the dispenser outlet and move the bottle along the conveying path a predetermined distance, wherein movement of the bottle along the predetermined distance causes a cap positioned on the bottle mouth to frictionally engage the arcuate wall and wheel and rotate relative to the bottle and so as to become threadingly engaged with the bottle mouth.

9. The bottle filling apparatus of claim 8, wherein the arcuate wall comprises a tactile surface that resists slippage of a cap in contact therewith.

10. The bottle filling apparatus of claim 8, wherein the capping station further comprises a guide panel, wherein the guide panel comprises an inclined surface configured to engage an upper surface of the screw cap and apply downward pressure on the cap as the bottle is moved along the predetermined distance.

11. The bottle filling apparatus of claim 10, wherein the guide panel has an arcuate configuration.

12. The bottle filling apparatus of claim 8, wherein the screw cap dispenser comprises:

an elongated bottom wall; and a pair of spaced-apart, elongated side walls that extend upwardly from the bottom, wall to define a channel sized to slidably receive a plurality of screw caps therein in single file arrangement.

13. The bottle filling apparatus of claim 12, wherein at least one side wall comprises a free edge having an inwardly extending lip, wherein the inwardly extending lip is configured to permit a screw cap in an upright orientation to slide along the channel and to not permit a screw cap in an inverted orientation to slide along the channel.

14. The bottle filling apparatus of claim 12, wherein the channel is inclined relative to horizontal such that screw caps within the channel are gravity-fed to the dispenser outlet.

15. The bottle filling apparatus of claim 8, further comprising a fourth sensor configured to detect presence of a cap at the dispenser outlet.

16. The bottle filling apparatus of claim 1, wherein the sensor system comprises:

a first sensor configured to detect the presence of a bottle at the liquid filling station; and a second sensor configured to detect a liquid level in a bottle at the liquid filling station.

17. The bottle filling apparatus of claim 1, further comprising a gate movably supported by the frame upstream of the filling station and movable between open and closed positions, wherein the gate blocks bottle movement along the conveying path when in the closed position, and wherein the gate allows bottle movement along the conveying path when in the open position.

18. The bottle filling apparatus of claim 1, wherein the apparatus has a footprint of no greater than about 240 $in^2$.

19. A portable, automatic bottle filling apparatus, comprising:

a housing;

an elongated frame enclosed within the housing that defines an endless conveying path, wherein the housing comprises an access door movable between closed and opened positions to provide access to the conveying path;

a conveyor system supported by the frame that moves bottles along the conveying path, the conveyor system comprising: a friction drive pulley supported by the frame adjacent to a conveying path first end;

a belt drive pulley supported by the frame adjacent to a conveying path second end;

an endless belt extending about the friction drive and belt drive pulleys, wherein the endless belt is configured to frictionally engage bottles in the conveying path; and a motor assembly supported by the frame, the motor assembly including a motor and motor shaft that is rotatably driven by the motor, wherein the belt drive pulley is operatively coupled to the motor shaft, and wherein rotation of the belt drive pulley via the motor causes the endless belt to move and thereby convey bottles along the conveying path;

a liquid filling station supported by the frame adjacent to the conveying path that is configured to fill an empty bottle with liquid from a liquid source;

a capping station supported by the frame downstream from the liquid filling station that is configured to close a filled bottle with a cap, the capping station comprising:

a screw cap dispenser supported by the frame and positioned above the conveying path, wherein the dispenser comprises an outlet configured to releasably retain a screw cap therein such that a mouth of the bottle moving along the conveying path from the liquid filling station makes contact with the screw cap and causes the outlet to release the screw cap onto the bottle mouth;

an arcuate wall positioned above the conveying path downstream from the dispenser outlet;

a rotatable wheel positioned above the conveying path downstream from the dispenser outlet in spaced-apart relationship with the arcuate wall; and a rotatable gripper arm operatively coupled to the motor shaft and configured to engage a bottle located under the dispenser outlet and move the bottle along the conveying path a predetermined distance, wherein movement of the bottle along the predetermined distance causes a cap positioned on the bottle mouth to frictionally engage the arcuate wall and wheel and rotate relative to the bottle and so as to become threadingly engaged with the bottle mouth;

a sensor system configured to detect the presence of an empty, uncapped bottle at the liquid filling station; and a controller that controls operations of the liquid filling station, capping station and conveyor system in response to signals received from the sensor system.

20. The bottle filling apparatus of claim 19, wherein the frame comprises:

a floor; and at least one panel vertically spaced from the floor and substantially parallel therewith;

wherein the at least one panel has an opening formed therein that at least partially defines the conveying path, and wherein bottles supported on the floor in an upright position are movable along the conveying path.

21. The bottle filling apparatus of claim 19, wherein the liquid filling station comprises:

a nozzle positioned above the conveying path; and a conduit coupled at an inlet with the liquid source and at an outlet with the nozzle, wherein the conduit comprises a valve configured to control the flow of liquid through the nozzle from the liquid source.

22. The bottle filling apparatus of claim 19, wherein the capping station further comprises a guide panel positioned above the conveying path second end, wherein the guide panel comprises an inclined surface configured to engage an upper surface of the screw cap and apply downward pressure on the cap as the bottle is moved along the predetermined distance.

23. The bottle filling apparatus of claim 19, further comprising a sensor configured to detect the presence of a cap at the dispenser outlet.

* * * * *

UNITED STATES PATENT AND TRADEMARK OFFICE

CERTIFICATE OF CORRECTION

PATENT NO. : 9,150,399 B2
APPLICATION NO. : 12/768819
DATED : October 6, 2015
INVENTOR(S) : Michelli et al.

It is certified that error appears in the above-identified patent and that said Letters Patent is hereby corrected as shown below:

In the Claims:

Column 16, Claim 15, Line 8: Please correct "a fourth sensor"
to read -- a sensor --

Signed and Sealed this
Fifth Day of April, 2016

Michelle K. Lee

Michelle K. Lee
*Director of the United States Patent and Trademark Office*